United States Patent [19]

Nelson

[11] 3,947,239

[45] Mar. 30, 1976

[54] DESCENDING BED OF SUB-DIVIDED SOLID MATERIAL

[76] Inventor: Philip Henry Nelson, The Old Rectory, Snargate, Romney Marsh, Kent TN29 OEW, England

[22] Filed: Nov. 1, 1974

[21] Appl. No.: 520,170

[30] Foreign Application Priority Data

Nov. 12, 1973 United Kingdom .....52385/73

[52] U.S. Cl. ..... 432/14; 34/168; 432/98

[51] Int. Cl.[2] ..... F27B 15/00; F27B 1/26

[58] Field of Search ..... 432/14, 98; 34/168

[56] References Cited

UNITED STATES PATENTS

| | | | |
|---|---|---|---|
| 1,429,925 | 9/1922 | Candlot | 432/61 X |
| 2,945,687 | 7/1960 | Davis | 432/98 X |
| 3,331,595 | 7/1967 | Nelson et al. | 432/98 |
| 3,403,895 | 10/1968 | Hatfield et al. | 432/98 X |

*Primary Examiner*—John J. Camby

*Attorney, Agent, or Firm*—Sherman & Shalloway

[57] ABSTRACT

A method of processing granular material by passing a gas in contraflow to a bed of the material descending in an independently rotatable annular chamber of annular width a surmounting an annular eccentrically rotating floor, the outer bed wall being in gas-tight sliding relationship to the floor but the inner wall being spaced above the floor by a distance h, not less than, and not more than 10 percent in excess of, the value satisfying the relationship tan $\phi = h/a$ where $\phi$ is the operative angle of repose of the charge material at the bottom of the bed.

17 Claims, 18 Drawing Figures

2
2'
C
D
h
Ø
2e
E
B
θ
a tan θ
F
G
1
Rm

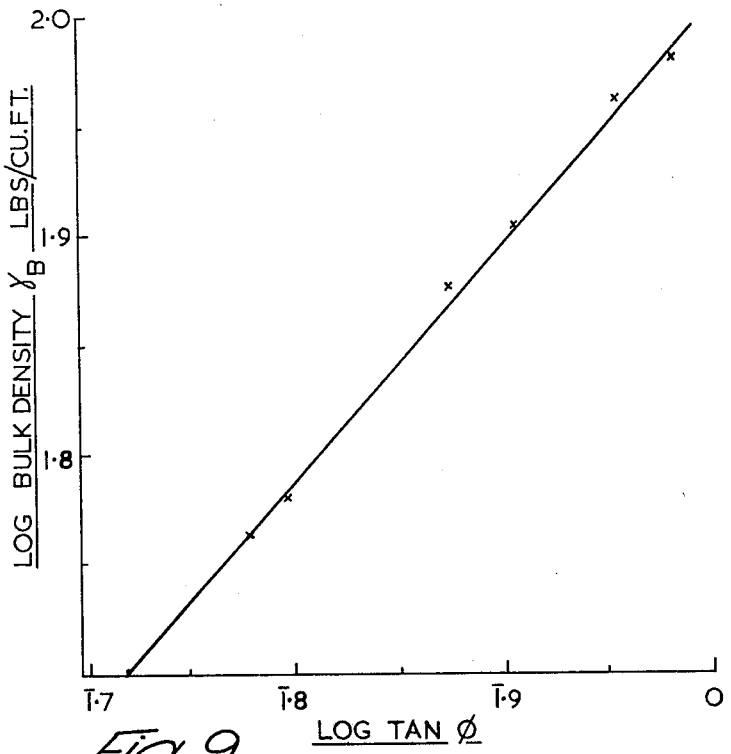
Fig. 9.
Fig. 10.
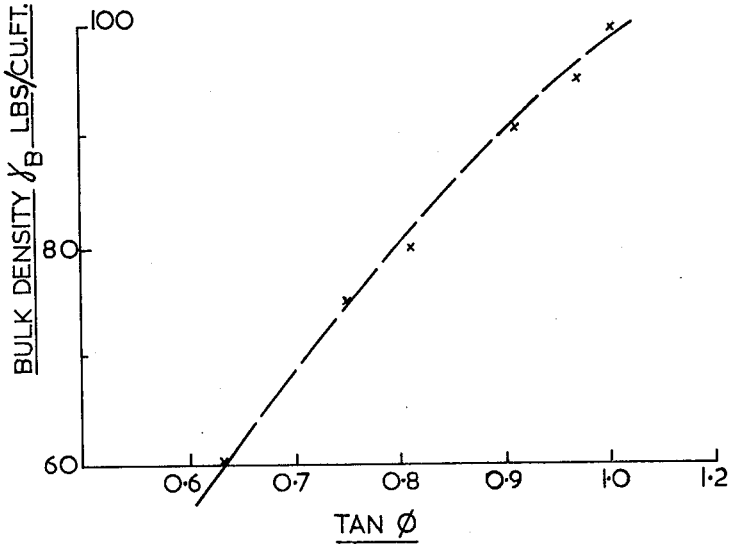

TAN Ø
1·0
0·9
0·8
0·7
0·6
10
20
30
40
50
60
GRADING FACTOR P (+1"/-3/8")

MEAN PARTICLE DIAMETER $d_m$ FT. x $10^{-3}$
12
10
8
6
4
2
0
10
20
30
40
50
60
GRADING FACTOR P(+1"/-3/8")

DESCENDING BED OF SUB-DIVIDED SOLID MATERIAL

FIELD OF THE INVENTION

The present invention relates to the control of the descent of sub-divided solid material in a bed thereof in counterflow to a gas. More particularly the invention relates to the control of such descent in a bed of annular horizontal cross-section, for instance to regulate contact between the solid and the fluid.

The invention will be described with particular reference to annular apparatus for contacting a solid with a gas for the purposes of heat exchange or reaction, such as an annular kiln, but it will be understood that the principles of the invention also apply in the foregoing wider context to annular beds of granular and nodular solids in general.

BACKGROUND OF THE INVENTION

The principles of the invention will be more readily appreciated if one first considers the derivation of the annular kiln from the ordinary vertical kiln or shaft furnace.

With most forms of vertical kiln or shaft furnace for the treatment of, for instance, ferrous or non-ferrous ores, cement clinker, dolomite, lime or the like, the removal of the finished or heat-treated product from the lower, i.e. discharge, end of the shaft is rendered difficult by the fact that the whole mass of material under treatment filling the shaft should be encouraged to bear directly on the discharge means, so that the material will be engaged over the whole cross-section and the charge will sink as uniformly as possible through the shaft, thereby to maintain reasonably consistent gas permeability over the full effective cross-section.

Such difficulties were discussed for instance by H. Eigen (Zement-Kalk-Gips, October 1956, pages 454 – 456), K. Beckenbach (British Patent Specification No. 934,230), H. R. Suter (U.S. Pat. No. 2,861,788; assigned to L. von Roll, A.G.,) E. Spohn (Tagungsberichte der Zement-industrie, 1955, 11, 39 – 55), F. P. Somogyi, "The Vertical Kiln" (Cement Lime and Gravel, May 1952), and B.A.S.F (British Patent Specification No. 950,576).

These references also show that because of the lack of uniformity of the load across the shaft cross-section and the correspondingly uneven discharge rates from the centre to the perimeter or outer wall, not only is the material heat treatment irregular but it is also impossible, for example in the case of the calcination of limestone or dolomite, to obtain a product that is of a uniformly porous quality and in which an original size grading is retained as far as possible. As stated by K. Beckenbach, these characteristics can only be incompletely achieved even with the best of existing discharge devices and his approach was intended to discharge the material from the shaft furnace uniformly and without undue crushing, by the introduction of a fixed discharge table which, when disposed below the lower opening of the furnace and having a larger diameter than that opening, introduced stabilising and load-shedding characteristics according to the angle of repose of the material at the perimeter, thus leaving the extractor gear free to complete the feeding off action.

Furthermore the uniform treatment of the material in a shaft system can be seriously interfered with by the loosening action which must take place at the perimeter or outer wall and which has hitherto limited the maximum diameter of most stationary shaft systems to a few metres.

Various attempts were made both to increase the capacity and to improve the performance of shaft kilns or preheaters by the inclusion of core sections, thereby introducing the annulus principle, but in every case these have again been based on static arrangements with no relative movement between the outer shaft and the inner core walls; an interesting attempt was also made by B.A.S.F. both to incline and to rotate a shaft kiln so as to prevent hold-ups in the burning zone and give a more intimate mixing of the solids and hot gases. The fact that all of these arrangements would prove extremely complicated in both their manufacture and operation appears to have hindered their practical application.

In U.S. Pat. No. 2,842,350, M. Berz proposed a fixed annular shaft furnace in which the central opening in the annular floor, for the discharge of solid material which had descended through the annular shaft, was smaller than the inner diameter of the annular shaft. A ring structure was supported coaxially above the centre floor opening, forming a channel for gas to be passed upwards and thence through the annular bed, while treated solid was discharged over the edge of the floor under the ring structure. The gas was to enter the bed of solid material through the surface of the solid charge material sloping down from the inside bottom of the annular shaft, to the top of the ring structure.

Our own approach to this general problem can be said to have started with the annular preheater designed by R. V. Beal and L. H. Bishop, (British Patent Specification 828,886) in which we managed to overcome the main disadvantages of the Berz annular preheater by putting an eccentric discharge port in the floor and by rotating the bowl constituted by the floor and the wall and adopting an external cam track to work the pusher discharge rams to push the treated solids to the edge of the port. These measures virtually eliminated both the feeding and sealing problems which, at the fairly high operating suctions associated with deep bed up-draught operation, had been responsible for the lack of commercial success with the Berz design. The Beal approach had, however, still not fulfilled the essential need for continuous and uniform feeding of a granular or nodulised solid because, as will be more clearly explained later in this description, the bowl, its floor and the inner dome remained in fixed geometrical relationship to one another. Moreover the intermittent pusher discharge action could not help but impose unacceptably high disruptive forces on the solid material being treated and was unable to provide the uniformly distributed feed-off action and the regimented downward flow of the solids so essential for efficient contra-flow heat exchange.

In the annular preheater or Riln, described in our British Patent Specification 828,888 and U.S. Pat. No. 2,945,687, G. G. J. Davis took a significant step forward towards overcoming the above mentioned drawbacks, in that the floor or hearth on the one hand, and the walls of the annulus — sometimes referred to as the bowl (outer) and dome (inner) — on the other hand, were mounted to rotate about their respective central vertical axes, but these parallel axes were spaced from each other by a certain offset distance. The resulting precession and interaction between the bowl wall and the floor, which we shall call the Offset Feed Action, caused solids at the bottom of the bed to be pushed to and over the edge of the discharge port. The cam arrangements of the earlier versions were thereby dispensed with, and the effect of the offset action in this case was equivalent to an infinite number of radial pushers around the circumference, resulting in a solids flow of improved smoothness under favourable conditions.

During the rotation of the Davis preheater through one complete revolution, the relative motion between the annulus and the floor is circular, i.e. the locus of a point in the rotating annulus with respect to the rotating floor is a circle having a radius equal to the offset distance, assuming that the annulus and floor are rotated in unison, i.e. at the same angular velocity and neither lags behind the other. Such rotation in unison would be obtained in practice only by applying suitable positive drive both to the floor and to the annulus; if the floor alone were positively driven, the reactions between floor, solid charge material and annulus walls would not cause the annulus to rotate without some slippage with respect to the floor, so that the above mentioned locus would depart from circular and tend towards a cycloid curve.

According to U.S. Pat. No. 3,403,895, assigned to Dravo Corporation, P. E. Hatfield and L. H. Jacquay attempted to emulate the relative circular motion between annulus and floor of the Davis preheater, without actually revolving the annulus or the floor about their own central vertical axes, by imparting an orbital motion to either the floor or the annulus only, e.g. by rotating the vertical axis of the floor about the vertical axis of the annulus. Their ostensible purpose was to reduce the power requirement of the system; it would, however, require more power than the Davis system and it could only handle a solid charge capable of withstanding prodigious crushing forces, largely because it could permit no tangential slip between floor, charge and annulus walls.

The advantage of providing some tangential movement, in a partially analogous situation, was noted by C. Candlot in U.S. Pat. No. 1,429,925. Candlot mounted a horizontal grate below a shaft furnace, leaving a peripheral space between the bottom of the shaft and the grate below it. The grate was subjected to a planetary movement whereby solid charge material from the furnace, resting on the grate, was withdrawn radially outwards and spilled over the edge of the grate to a hopper. According to Candlot the planetary movement caused a tangential movement of the material covering the grate, thus avoiding any jamming that night otherwise occur between the grate and the shaft.

It is important to appreciate that all the annular preheaters and kilns thus far referred to, have relied for their discharge substantially entirely upon a pushing action applied by a circumferential member such as a ram or a wall, to compel the charge material to move inwardly from the bottom of the annular bed proper, across the floor to the discharge outlet in the floor. This pushing or ramming action, as will be more fully explained later, involves the exertion of considerable forces upon the actual charge material and upon the bearing supports of the equipment, with concomitantly high rates of degradation of the charge and wear on the machine parts.

Our British Patent Specification 1,059,149 and U.S. Pat. No. 3,331,595, both describe some modifications made by P. H. Nelson to the Davis annular preheater or kiln, mentioned above, having the offset feed action. These modifications included (1) a change from the flat horizontal floor, to a floor sloping conically downwards towards the centre at a shallow angle to the horizontal, and (2) the provision of sealing means at the extremities of the bowl and dome which permit quite independent rotation of the three components: hearth or floor, bowl or outer wall, and dome or inner wall.

The Nelson-Davis annular heat exchanger which forms the subject of British Patent Specification 1,059,149 and U.S. Pat. No. 3,331,595, operates like its predecessors in pushing the charge material across the hearth for discharge through the aperture, except under particular circumstances to which the present invention is directed, and which are applicable by virtue of the two modifications mentioned above. We have found that apparatus of the immediately foregoing type providing an annular bed of descending granular or nodular material, can be operated in a decisively advantageous manner if the geometrical design and control of the apparatus bear a suitable relationship to the physical properties of the charge material of the bed. When the relationship is suitable, the apparatus may be said to operate in a critical mode, in which the pushing action already referred to is superseded by action of a different kind, and advantages enumerated in the following description are attained.

It is an object of the present invention to provide conditions for operating an annular bed, of descending granular or nodular material, in the critical mode referred to.

DESCRIPTION OF THE INVENTION

The charge material

The charge material may be any solid granular or nodular material so long as it is not so fine or light that contraflow gas to be passed through it will lift it all up, and so long as it is not composed of particles too large in relation to the width of the annular space, to fall freely down such a space together.

Type of Apparatus

In the type of apparatus to which the invention applies, an annular base, which we shall call a floor or hearth, occupies a substantially horizontal plane and is mounted for rotation about its substantially vertical central axis. Surmounting the floor are two substantially coaxial cylinders having their central axes substantially vertical and displaced from the parallel axis of the floor by a distance we call the offset distance. The stroke length later referred to, is twice the offset distance.

The outer one of these two cylinders, which we call the bowl, is mounted for independent rotation about its axis and the bottom of the cylinder forms a sliding seal with the floor. The inner one of the two cylinders, which we call the dome, is also mounted for independent rotation about its axis but the bottom of this latter cylinder is spaced above the floor level (i.e. the horizontal diameter of the floor surface) by a certain distance which we call the choke height, the bottom rim of the dome being referred to as the choke. The dome is preferably supported in such a way as to permit its axis to tilt away from the vertical by a small angle, herein referred to as the angle of tilt. The central aperture of the annular floor is of smaller diameter than the dome and is the discharge aperture. The upper face of the floor slopes downwardly from the floor periphery to the central aperture in the floor at a shallow angle to the horizontal, which we call the floor angle, ($\theta$), forming the floor into a shallow cone.

The respective cylinders form two sliding seals with the outer and inner edges respectively of an annular top cover or hood which confines the annulus between the cylinders but leaves open to the atmosphere the upper side of a roof which spans and closes the dome. The underside of this roof slopes upwardly and inwardly towards its centre from the periphery, i.e. from the choke, at an angle which we refer to as choke relief. The top cover, which remains static, incorporates an inlet for feeding in solid charge materials and one or more outlets for emitting gas or vapour.

As already stated, the floor aperture diameter must be less than the dome diameter by a certain amount defined later herein. When this condition, which we refer to as the stability criterion, is satisfied, sub-divided solid material charged into such apparatus does not fall straight out through the aperture but forms a stable bed in the annular space between the cylinders and also spills over the floor in a radially inward direction to an extent depending initially on the angle of repose of the sub-divided solid material.

In operation, the parts of the apparatus thus described, apart from the top cover, rotate about their respective said axes. The present invention is concerned with apparatus of the type described in which only the rotation of the floor is directly due to the application of powered drive means therefor: there are no mechanical links between the bowl and the dome, nor between either the bowl or the dome and the floor. The observed rotation of bowl and dome when the floor of the charged apparatus is driven, is due to the interaction between the three independently rotatable components (floor, bowl, and dome) and the solid charge between them.

For the purposes of explaining and ascertaining the present invention we refer to the line joining the choke to the nearest point on the bottom rim of the bowl as the choke line or slope, and we refer to the frustoconical surface generated by this line as the annulus makes one revolution about its axis, as the choke interface, regardless of whether it be considered to have a real or merely hypothetical existence.

The annular width is defined by the difference between the respective radii of the bowl and the dome. We consider the annular bed to be bounded laterally by the bowl and dome respectively, bounded above by the level it adopts in operation and bounded beneath by the choke interface. Sub-divided solid material disposed below or radially inwards from the choke interface may be regarded simply as material resting on the floor in the course of discharge from the bed.

The eccentric rotation of the floor with respect to that of the bed, in causing removal of the solid material from under the bed in a radial direction, subjects the material to some angular compression, which finds relief in an increase in height of the pile with decreasing radius, until the material slides over the edge of the aperture in the floor.

Some embodiments of the apparatus described in the above mentioned British Patent Specification 1,059,149, and U.S. Pat. No. 3,331,595, will be found to exemplify the aforesaid type of apparatus utilised in the invention.

The Critical Mode

In general terms, which will be more readily understood in the light of the following particular description, an annular bed apparatus of the type described, when operating in the critical mode, is characterised by the peculiar ease and smoothness with which the charge feeds through and out of the bed. Such operation is obtainable by means of the invention and is recognisable by a number of observable and quantifiable results, which will be hereinafter defined.

Accordingly the present invention in one aspect comprises operating an annular bed of the type described, in the critical mode.

In the critical mode, granular or nodular material can descend in the bed in a regular manner hereinafter defined, whereby substantially every piece of the granular or nodular material undergoes a substantially similar cycle of treatment as it passes in counterflow to a rising gas through the full height of the bed as hereinbefore defined, i.e. the annulus.

Regular Descent

The regular manner in which charge material should descent through the bed is defined as follows, disregarding differences in rotational speed between the annulus and the floor:

In the ideal case, each piece of solid charge material, in travelling from the top to the bottom of the annular bed as hereinbefore defined, describes (not relative to the rotating apparatus but relative to the earth) a vertical helix of constant radius and constant pitch at a constant horizontal component of angular velocity. The constant radius is equal to the distance of the piece from the axis of rotation of the annulus, the constant pitch is proportional to the stroke length of the apparatus and the horizontal angular velocity is equal to that of the annulus as a whole. The stroke length is defined as twice the distance between the axis of rotation of the floor and the axis of rotation of the annulus.

Accordingly the solid charge descends substantially without any horizontal mixing and each part descends through the same distance for any given complete revolution of the annulus; consequently, as long as the top of the bed is supplied at a uniform rate with uniformly distributed charge material, uniform distribution and uniform residence time is maintained as the charge material descends uniformly through the bed.

Since the bed is steadily rotating it is a simple matter to feed the charge material to it at a uniform rate from a fixed point above it and thereby achieve uniform distribution in the circumferential direction. Indeed, because the advance of the charge material through the apparatus is dependent upon the discharge rate, and as will be seen later the discharge rate can be held constant according to the invention, the uniform feed rate can be achieved simply by keeping the level of the top of the bed constant, e.g., by automatic means linked to the speed. Uniform distribution in the radial direction is assured by feeding the material to the top of the bed close to the inner wall of the annulus and causing or allowing the top of the bed to slope down towards the outer wall at the effective angle of repose of the charge material.

Relative to the rotating annulus, each piece of solid charge material travels down a substantially vertical path through the bed, but whether considered relative to the annulus or relative to the earth, the vertical component of velocity of the charge material is not constant; each part of the charge undergoes in each complete revolution the same constantly recurrent cycle of acceleration and deceleration, as will be more fully explained in relation to the withdrawal action. Accordingly the slopes of succeeding turns in the abovementioned helical path are not constant but are parallel to one another.

In practice the regular descent of material departs from the ideal described but is considered to be within the scope of the invention if the following Primary Relationship holds.

Primary Relationship

The invention is based on the realisation that in order to operate annular bed apparatus of the type defined above in the critical mode, it is necessary to maintain substantial equality between (a) the angle the choke interface makes with the horizontal and (b) the operative angle of repose of the charge material under the choke. By "substantial equality" we mean in this context that the choke height H shall be not less than, and not in excess of ten percent more than, the value satisfying the relationship (1):

$$\tan \phi = h/a \qquad (1)$$

where $\phi$ is the said operative angle of repose, a is the width of the annular space, and $h$ is the perpendicular height of the choke above the periphery of the floor.

According to one aspect therefore, the present invention comprises dimensioning or operating an annular bed of the type defined, so that the above mentioned substantial equality is provided.

It will be apparent that apparatus to which, and in which, the present invention can be applied, has already been disclosed, particularly in British Pat. Specification No. 1,059,149 and U.S. Pat. No. 3,331,595 and used in various parts of the world for instance in the manufacture of cement and coke, and the treatment of ores and other minerals. What have not hitherto been recognised, however, are (a) the existence of the critical mode, (b) the particular embodiment of the apparatus that must be selected and (c) the conditions and relationships which must be fulfilled, whereby the form of solid discharge can be obtained which is characteristic of the present invention and is now to be described.

Charge Withdrawal Action

The discharge of solid granular material from the annular bed in the practice of the present invention is more aptly referred to as the withdrawal action, because the material is not forced or pushed out, but carried out, from the bottom of the bed. The regular descent already referred tok is a direct result of the withdrawal action.

It is helpful to consider first the interrelation of the parts of an annular bed resting on a concentric annular floor. If we take the outer wall of the empty annulus, resting on the concentric annular floor without the inner wall, we have in effect a tube with an internal rim around the bottom circumference. We can load granular material on this rim until the full width of the rim is occupied; the top of the pile of granular material will have an inverted frusto-conical surface with a slope corresponding to the drained angle of repose of the granular material. If any further granular material is added, it will all slide off at once through the floor aperture. For convenience of expression we shall refer to such behaviour as "running off."

If we now lower a concentric inner wall, of larger diameter than the floor aperture, into the outer wall at least until the bottom edge of the inner wall just touches the sloping pile of granular material, we shall be able to add further granular material to the annular bed between the walls without any of the material running off. We refer to such a bed as stable, and later in this specification we define the necessary relationship between the charge material and dimensions of the apparatus for stable operation in the critical mode, as the stability criterion.

The function of the withdrawal action is to draw from under a stable annular bed, charge material which has descended through the bed, drawing it in a generally radial direction across the rim or annular floor to be dropped through the floor aperture, without disturbing the stability of the bed, and in particular to thereby facilitate operation in the critical mode.

The withdrawal action is obtained when the annular floor is not concentric with the annular bed and is rotated about its central axis while the above mentioned primary relationship is satisfied. If (a) the eccentric rotating annular floor has a central aperture (the aperture being concentric with the floor) which is as big as the outer wall of the annular bed, all the charge material in the bed will, of course, fall straight out through the floor. If (b) the diameter of the aperture, allowing an extra margin for the eccentricity, is less than the limit for stability, the bed will of course remain stable. Between these two conditions (a) and (b) the charge material will "run off" to a greater or lesser extent according to the extent by which the aperture undercuts the otherwise stable bed and for what proportion of each revolution it does so.

If the aperture is small enough to permit the bed to remain stable, charge material will be moved in a generally radial direction across the floor to the aperture, by virtue of the relative reciprocatory action between floor and bed caused by their eccentric rotation. In this movement across the floor the charge experiences a pushing force unless the withdrawing action of the invention is achieved by operating in the critical mode.

If the aperture is too small to allow the material transferred across the floor to pass through it, the transferring movement will, of course, come to a halt.

In the operation of annular bed apparatus hitherto it has been observed that the rate of discharge of solid material from the bed has been dependent upon the size of the discharge aperture in the floor.

If the discharge rate is found to depend on the aperture size, three possibilities arise:

1. the aperture is far too small; this possibility has been referred to above;

2. the aperture is too big and fails to satisfy the stability criterion; charge material "runs off," i.e. discharges at an undesirably high and uneven rate;

3. the discharge is being brought about by the action of the annulus wall pushing the charge material across the floor, and consequently the rate depends upon the size of the pile of material to be pushed, and hence upon the distance from bed to aperture.

These possibilities do not, however, arise when operating in the critical mode, when the withdrawal rate is substantially independent of discharge aperture size for a stable bed.

We refer to the diameter passing through the respective centres of rotation of the outer wall and of the floor as the off-set axis and we use this axis as a datum line in describing the movements of the annular bed apparatus. During the rotation of the floor, any given point on the surface of the floor follows a locus which alternately approaches and recedes from the centre of rotation of the annular bed, in the reciprocatory relative motion between bed and hearth which brings about the withdrawal of the charge material from the bed. When that given point is at its furthest distance from from the centre of rotation of the bed, it will be on the offset axis at a position which we refer to as the $\gamma = 0°$ position. For the purposes of explanation it is not important whether all positions on the locus of the given point, from $\gamma = 0°$ to 360° with respect to the offset axis, are taken about the centre of the annular bed or of the floor when the offset distance is small in comparison with the diameter of the floor, but for clarity we take the centre of the floor as the angular reference point for rotational position of the apparatus.

Each point on a given radius of the floor, in passing round from the $\gamma = 0°$ position to the $\gamma = 180°$ position during half a revolution of the floor, will approach the axis of the annular bed by a total distance equal to twice the offset distance, i.e., equal to the stroke length of the apparatus, at a rate of approach which increases gradually and in proportion to sin $\gamma$ from zero at the $\gamma = 0°$ position, reaches a maximum at the $\gamma = 90°$ position and decreases in proportion to sin $\gamma$ from the maximum back to zero at the $\gamma = 180°$ position. Solid charge material resting on the floor will accordingly in the critical mode of operation, be carried toward the axis of the annular bed at the stated rate of approach. The effective radius of the floor exposed to the annular bed will increase by one stroke length, again at the stated rate, as points on the floor radius which were outside the outer wall pass to positions within it. The increase in effective radius will, in the critical mode, permit access of further charge material to the floor below the bed, resulting in descent of charge material in the bed, through a total distance equal to tan $\phi$ $x$ stroke length, at a rate of descent which increases gradually in proportion of sin $\gamma$ from zero at the $\gamma = 0°$ position, reaches a maximum at the $\gamma = 90°$ position and decreases gradually in proportion to sin $\delta$ back to zero at the $\gamma = 180°$ position. Thus while the charge is withdrawn from under the bed during this half revolution, the material descends in the bed and the bed can be correspondingly filled at the top most conveniently in the region above the $\gamma = 90°$ position. The half revolution from $\gamma = 0°$ to $\delta = 180°$ is therefore the filling stroke. During the fiflling stroke the bed becomes mobile and more highly gas permeable.

Each point on a given radius of the floor, in passing round from the $\gamma = 180°$ position to the $\gamma = 360°$ position during half a revolution of the floor, will recede from the axis of the annular bed by a total distance equal to twice the offset distance, i.e., equal to the stroke length of the apparatus, at a rate of recession which increases gradually and in proportion to sin $\gamma$ from zero at the $\gamma = 180°$ position, reaches a maximum at the $\gamma = 270°$ position and decreases gradually in proportion to sin $\gamma$ from the maximum back to zero at the $\gamma = 360°$ position. Solid charge material resting on the floor will, in the oritical mode of operation, be stabilised by the presence of the bed and will remain at a more or less fixed distance from the axis of the annular bed as the floor undercuts the solid charge material. The latter will accordingly advance with respect to the floor towards the floor aperture, at a rate substantially equal to the above mentioned rate of recession. After preliminary revolutions during which the floor becomes covered with solid charge material, there will be a steady discharge of solid charge material over the edge of the floor aperture, at a rate increasing gradually and substantially in proportion to sin $\gamma$ from zero at the $\gamma = 180°$ position, reaching a maximum at the $\gamma = 270°$ position and decreasing gradually in proportion to sin $\gamma$ from the maximum back to zero at the $\gamma = 360°$ position. During the half revolution from $\gamma = 180°$ to $\gamma = 360°$ the charge material in the bed remains substantially stationary while that which is undercut by the floor aperture falls out through the aperture. This half revolution is the discharge stroke. During the discharge stroke the bed becomes static and less permeable to gas.

In the alternating sequence of filling strokes and discharge strokes experienced by a particle of solid charge material after entering the top of the bed, the particle descends the cascade of stages, of period tan $\phi$ $x$ stroke length, which is the constant pitch of the helix mentioned above.

The machine forces acting on the charge material in the critical mode are those arising from resistance to movement across the floor (not in passing from bed to floor) which resolve radially. These forces are minimised particularly as follows.

The friction factor F between charge material and floor is beneficially reduced by sloping the hearth downwardly toward the centre at an angle $\theta$ of say 5° to 7½°, or more; the friction factor reduces to zero in the region of 25° slope but at slopes exceeding about 20° the stability of the bed becomes uncertain. The slope of the floor, is of course, not taken to the extreme periphery of the floor, since the part of the floor which oscillates directly under the outer wall must be flat and horizontal.

The friction factor F is further reduced to F cos $\beta$ if the solid charge moves at an angle $\beta$ to the floor radius; it is inherent in an annular bed with an offset rotary discharge system that part of the path of the granules or nodules of the solid charge material will be at an angle to the radius. In the annular bed apparatus utilised in the present invention the annulus walls are free to rotate independently of each other and of the floor, and consequently the outer wall is free to rotate more slowly than the driven floor. If the withdrawal of the charge material is achieved with negligible force between the charge material and the outer wall, i.e., in the critical mode, there must be tangential slip in the system such that the rotating outer wall lags behind the rotating floor by a circumferential distance approaching or equal to the stroke length in each complete revolution. The locus of a point on the outer wall relative to the floor will be a cycloid curve, instead of the circle which characterised the prior art Davis and Dravo annular bed apparatus. The angle $\beta$ is consequently the greater and the friction factor the smaller, than it would be in the absence of slip.

The machine forces are also minimised when using a closely graded solid charge material, as more fully discussed below.

The action of the apparatus produces a resultant thrust between the floor and the outer wall. This thrust resolves in a constant direction if the apparatus is in the critical mode; the walls and floor being mounted for independent rotation, the thrust is exerted at right angles to the offset axis, i.e., on the outer wall, where it can be measured, at the $\gamma = 270°$ position, and on the floor at the 90° position (where measurement is not made, because the drive is applied to the floor). In critical mode operation the amount of the thrust diminishes towards the ideal in which it represents the resultant of the drive forces and machine friction, e.g., in supporting rollers, with negligible charge material friction, since the force which moves the charge through the apparatus will be almost entirely gravitational.

In general the rotation of the inner wall of the annular bed follows that of the outer wall, so that the annular bed revolves generally as one unit although the charge material is descending, as already described, in paths parallel to the walls. There are minor variations in the apparent rotation rate of the inner wall; if, as is preferable, the inner wall is mounted to be capable of some tilt away from the vertical axis in any plane, according to the attitude it tends to adopt in response to the prevailing thrusts, it will indeed assume a slight tilt, generally along the offset axis in the $\gamma = 0°$ direction. This tilt, which affords a cushioning action for the charge material, involves a very slight eccentricity between the walls of the annulus, whereby the relative speed of the inner wall with respect to the nearest part of the outer wall increases and decreases in the course of each complete revolution. This tilt and speed variation accompanies a slight paddle-type action as the charge material revolves alternately through zones of slightly increasing and decreasing annular width.

A significant result of the ability of the walls to respond in a relatively free manner to thrusts which would otherwise be exerted on the charge material, is that the handling of the charge material is extremely gentle. In particular any tendency for charge material to form a bridge across the annular width, is cancelled by lack of support at the ends of the bridge, instead of culminating in damage to the charge.

The withdrawal action of the annular bed apparatus in the critical mode is to be contrasted with the discharge action of similar apparatus as operated hitherto.

If annular bed apparatus operating initially according to the invention is permitted to go out of the critical mode, for instance by too low a choke height, restricting the freedom of one of the walls or introducing degraded charge material into the bed (any one of which effects will bring about the others), a number of further significant changes occur in the behaviour of the apparatus and its charge, for instance:

1. The sector of the floor aperture rim, over which maximum discharge occurs, migrates from the $\gamma = 270°$ position towards the $\gamma = 360°$ position; instead of crossing the floor by way of the path of least effort, the solid charge waits to be forced off towards the end of the discharge stroke;

2. The position of maximum thrust on the outer wall also migrates from the $\gamma = 270°$ position towards the $\gamma = 360°$ position and the amount of thrust assumes relatively enormous values of an entirely different order from those encountered in the critical mode (see for instance the above mentioned Dravo Corporation U.S. Pat. No. 3,403,895); the power requirement rises steeply;

3. Whereas in the critical mode the circumferential lag between the outer wall and the floor approaches a value equal to the stroke length, and the effort involved in rotating the outer wall is minimal; when out of the critical mode the lag becomes less and the freedom of the walls to lag behind the floor is hindered by a tendency towards positive drive from the floor, through the charge; the inner wall may undergo considerable acceleration;

4. Grinding and crushing forces are applied to the charge material in the region of the choke such that the charge material will be degraded or the apparatus will suffer heavy wear, or both such effects will result together;

5. The movement and distribution of the solid charge material in the bed will become non-uniform in every sense, with sharp deterioration in gas flow control and performance generally and development of local phenomena such as hotspots; the apparatus becomes increasingly unpredictable and destructive whereas in the critical mode it is gentle, robust and easy to control.

In short, whereas in the critical mode the solid charge is primarily fed through the apparatus by the force of gravity, away from the critical mode the charge is fed through the apparatus primarily by applied motive power; the excess of the latter over the former in terms of energy finds expression in destructive effects.

In the critical mode, the charge material, having descended vertically down to the bottom of the annular bed, smoothly changes direction through 90° and progresses across the floor in an infinitely incremental, orderly manner. Moreover the operation of the apparatus in the critical mode, in any aspect of movement or performance, is continuous not only in the sense that it continues to occur, but also in the sense that any curve characterising its behaviour is free from discontinuities.

The practice of the present invention is not contingent upon the adoption of a particular theory of the mechanism of the smooth transition of the charge material through the choke region in the critical mode. The observed behaviour is, however, consistent with a choke transfer mechanism operating in the ideal case as illustrated in and referred to later with reference to the accompanying drawings.

In connection with the choke transfer mechanism it is observed that if the feed of solid charge to the annular bed apparatus is cut off at the source so that the machine begins to empty, the emptying process continues in the critical mode until there is an annular pile of material on the floor, the outermost upper surface of which is frusto-conical and at the $\gamma = 0°$ position coincides with the postulated choke interface whereas at the $\gamma = 180°$ position it is parallel to that interface but drawn inwardly from it by the stroke length of the machine. The crescent-shaped area of floor then extending behind the charge material and against the outer wall from a point at $\gamma = 0°$ to a maximum width equal to the stroke length at $\gamma = 180°$ and back to a point at $\gamma = 360°$, is substantially clean of charge material, but the machine is unable to empty itself any further. There is no material in the bed proper. We refer to this condition as the nominally empty condition. A similar machine relying on a pushing action for discharge, i.e., not in the critical mode, cannot empty itself to this extent.

The choke transfer mechanism is considered to act as follows in an annular bed apparatus filled with solid charge material and operating in the critical mode: when the floor is moving radially inwards relative to the annular bed during the filling stroke it carries with it all that solid charge material which lies under the choke interface, because by the definition of the critical mode the choke interface coincides with the effective angle of repose, or the angle of sliding friction, of the pile of solid material thus carried forward. As each part of the pile immediately under the choke interface makes an incremental movement away from the interface in a radial direction, a corresponding part of the material immediately above the first part across the interface is thereby permitted to fall by gravity to take the place of the first part. In the ideal case this action can proceed substantially without rearrangement or dilation of the charge.

During each filling stroke, therefore, a layer of solid charge is "peeled" off the bottom of the bed at the choke interface; this layer, brought away from the interface with negligible effort, has a length equal to half the (mean) circumference of the choke interface, and a cross-section which is a parallelogram having a vertical height equal to the choke height, a base equal to the stroke length and a side sloping at the effective angle of repose. A feed rate formula derived hereinafter on this basis is found in practice to agree within the limits of experimental error with data obtained on a wide variety of annular beds, varying in diameter from less than one metre to more than 10 metres and with an even larger range of throughput rates according to stroke length or rotation rate.

As the layer leaves the choke interface its place is taken by a layer of the same dimensions and sloping attitude, which has descended down the bed in the same attitude, at a rate of one layer depth (tan $\phi$ x stroke length) for each revolution of the bed, from an initial position at the top of the bed where proper feeding lays the solid charge down continuously at the effective angle of repose (of the feed). When the bed is operating in the critical mode the grading of the charge should not alter in the descent through the bed enough to cause any significant charge in the effective angle of repose.

The layer-by-layer advance of the charge material facilitates close control of its treatment in the bed, the layer depth being directly proportional to the stroke length, i.e., to the offset distance. The bed height can be held constant to within a tolerance of a fraction of the offset distance, by means of feedback regulation linked to the discharge applied to the supply device, instead of relying upon weighing. A bed top level variation of one layer depth, or one granule diameter can be achieved regardless of the mean path length of the bed material.

Maximum benefit is obtainable from this layer-by-layer treatment, by adopting a small offset distance, corresponding if desired even to a layer only one granule or nodule thick, so that the throughput is low per revolution but is brought up to the desired total rate by increasing the rotation speed of the bed.

All the work, e.g., heat exchange, or physical or chemical change, to be performed on the solid charge material by contraflow against updraught gas, is to take place within the bed proper where the descent of material is uniform and the residence time is uniform, i.e., above the choke interface. We consider now the movement of the charge material between the choke interface and the floor aperture, after that work has been done.

A given amount of solid charge material, while being carried by the floor in a radial direction towards the axis of the annular bed, i.e., towards the centre of a circle, must occupy progressively smaller circumferences of that circle. The volume of a given amount of the solid charge on the floor can be reduced only to a severely limited extent, so that the decrease in the circumferential direction or angular constraint, finds compensation in an increase in height of the pile of material, as referred to in more detail hereinafter with reference to the accompanying drawings. The above mentioned layer "peeled" from the choke interface accordingly shortens immediately in circumference in the act of being drawn from the bottom of the bed, and increases substantially correspondingly in height; each lump (granule or nodule) in the layer consequently follows a different radial path, making an angle with the floor which is the greater, the higher the lump in the initial position of the layer at the choke interface, until the path reaches the inner surface of the pile of charge material sloping down to the floor aperture rim at the effective angle of repose of the charge material. The angle of repose at this location will be very slightly greater than that under the choke in the critical mode.

Solid charge material entering the top of the operational bed close to the inner wall descends through the bed close to the inner wall, passes across the choke interface close under the choke point, rides at the top of the crater-shaped pile of charge material as it moves inwards over the floor, and slides finally down the inner slope, out through the discharge aperture.

Solid charge material entering the top of the operational bed close to the outer wall descends through the bed close to the outer wall, passes across the choke interface close to the bottom of the outer wall, and rides in contact with the floor to the discharge aperture.

The closer to the floor the material rides in the pile, the longer the time it spends in the pile; in the limiting case when the discharge aperture has maximum diameter the material at the top of the pile may be withdrawn in a single stroke of the apparatus whereas the material in contact with the floor remains in the pile for the duration of a number of strokes.

Stability Criterion

If $R_a$ is the radius of the discharge aperture in the floor;

$R_b$ is the radius of the 'bowl' or outer annulus wall;

$a$ is the annular width of the bed, i.e., the difference in the respective radii of the outer and inner walls of the annular bed;

$\theta$ is the angle of slope between the floor and the horizontal;

$\phi$ is the effective angle of repose of the charge material under the choke when the apparatus is operating in the critical mode; and if the effective angle of repose at the discharge aperture is assumed to be equal to $\phi$, and the offset distance is neglected as small in relation to $R_a$ and $R_b$, the stability criterion may be expressed by the following relationship (2):

$$R_a < R_b - 2a \left(1 + \frac{\sin\theta \cdot \cos\phi}{\sin(\phi - \theta)}\right) \quad -(2)$$

which specifies the maximum limit which must not be exceeded by the discharge aperture diameter if the bed is to be stable.

In general the discharge aperture diameter should not be more than the value determined by the stability criterion at the lowest expected angle of repose of the charge material, i.e., the angle corresponding to the best grading, which (because of the floor slope) requires the greatest floor width for stability. With this precaution the apparatus will remain stable if the grading deteriorates and the angle of repose consequently rises.

The pile of solid charge material carried on the floor radially away from the choke interface during the filling stroke, will tend to increase in height as it leaves the choke point, as will be more fully explained later. Ideally therefore the roof over the inwardly moving pile should slope upwardly from the roof periphery at the choke, to give relief, i.e., to accommodate the increase in height. Further relief is afforded by the downward slope of the floor.

Inadequate relief has the effect of a horizontal choke, as distinct from the vertical choke of height $h$. Some horizontal choke effect will be present unless the choke point is sufficiently sharp in relation to the offset distance; any appreciable area of roof surface extending horizontally inwards from the periphery at the choke, will give rise to substantial horizontal choke effect, compressing the pile, with consequent risk of degrading the solid charge material and departing from the critical mode.

If horizontal choke effect is present, the discharge aperture should be as large as possible within the limits set by the stability criterion at minimum angle of repose.

Angle of Repose

The angle of repose of a sub-divided solid material may be measured in the direct sense by pouring the material on to a flat supporting surface, or by draining some material from a pile over the edge of a flat supporting surface; the angle of repose, i.e. the angle between the sloping side of the resulting pile and the supporting surface, may then be directly measured but the poured angle of repose will generally be found to differ from the drained angle of repose.

It is not assumed that the dynamic or effective angle of repose $\phi$ of the solid charge material under the choke will be exactly the same (although it will be approximately the same) as the angle of slope directly observed either inside the apparatus or in an external pile of the same material. The effective angle of repose is the angle which fulfils the primary relationship (1) when the annular bed apparatus is operating in the critical mode; hence the effective angle of repose may be determined by an indirect method wherein the apparatus is brought into operation in the critical mode by adjusting the choke height for a given annular bed width, whereupon the angle $\phi$ may be found by substituting the operative values of choke height and annular bed width in the primary relationship (1).

The detection of operation in the critical mode is in practice not difficult, because the observed behaviour of the apparatus is so markedly distinctive in that mode, for instance in respect of output size grading quality, power requirement and general ease of running. As will be clear from the description already given, of effects of operation in the critical mode, the establishment of that mode can be ascertained by reference to optimum achievement of any one of a number of these effects, for instance as follows:

1. the circumferential lag in annular bed rotation behind that of the floor, is as close to the ideal value as the apparatus is found to be capable of achieving with the floor-to-wall seal in a free running condition;
2. the direction of maximum lateral thrust on the outer wall approaches $\gamma = 270°$ with respect to the offset axis as nearly as it can, and this maximum thrust reaches its lowest value;
3. any degradation suffered by the charge material is at a minimum;
4. the total drive power requirement is at a minimum;
5. the solid charge material is discharged over the edge of the floor aperture as near to the $\gamma = 270°$ position as the apparatus will allow;
6. the treatment of the solid charge material reaches the peak of uniformity and the feed rate approaches closes to the relationship (3) hereinafter defined.

In so far as the scope of the invention may depend on the degree to which any one of these effects approaches the optimum condition, this degree can readily be related by experiment to the range of choke height permitted by the primary relationship.

Values of $\phi$ can accordingly be determined to characterise given materials so that further apparatus can be designed and operated on them according to the invention.

Accordingly the invention provides a method of measuring the effective angle of repose, which in view of the mechanism involved could be considered the ideal or natural angle of repose. When the annular bed is fed with granular, nodular or pelletised material larger than 5 mm. the subdivided solids which emerge from the apparatus can be assumed to have substantially the same particle size distribution as those at the choke. For all practical purposes these solids will be nodules or granules which, depending on their initial state and the degree of breakdown to which they have been subjected, will range in a continuous size grading from a size of at least 0.3 mm., more usually at least 1 mm., up to a size not normally exceeding 4 cm. The grading itself may range from a predominantly one-size grading (particles predominantly of one size) to an aggregate grading approaching that in which the widest range of sizes is represented.

These distributions are illustrated in the accompanying drawings and correspond to an angle of repose ranging respectively from 30° to 45° in practice, for which tan $\phi$ may be taken to range from 0.6 to 1.0. The subject of grading is dealt with further below.

Material below 0.3 mm. in size will in general be removed from consideration by the flowing gas, being either held in suspension in the upper parts of the individual voids between granules or cleaned right out of the bed. Given sufficient gas pressure or fan suction, the annular bed can handle even the most seriously degraded material as long as the critical mode is maintained.

It has been found, however, that the values of $\phi$ thus obtained as described above, are related to other, measurable, parameters and that the latter can therefore be usefully adopted in the practice of the invention in the place of $\phi$.

Thus tan $\phi$ is found to have a substantially linear relationship, illustrated in the accompanying drawings and obtainable by experiment, with the bulk density $\gamma_B$ of the solid charge material at the point of discharge. This relationship applies satisfactorily over a range of specific gravity of from 1.5 to 4.0. This bulk density can, of course, be readily determined from the observed volumetric and mass feed rates determined at the discharge outlet.

Accordingly the invention provides a method of operating annular bed apparatus of the type described, wherein the primary relationship (1) is fulfilled for a value of $\phi$ corresponding to the observed bulk density of the discharged material.

Feed Rate Relationship

The volumetric feed rate equation obtained by considering the volume of the layer withdrawn under the choke in the critical mode in each complete revolution, is as follows. It is appreciated that the derivation of this equation, illustrated in the accompanying drawings, assumes that the choke transfer mechanism operates as postulated above; the significance of the equation lies, however, in its good conformity with observed data:

$$V_r = 2\pi e (R_m - e)(h + a \tan\theta) \quad (3)$$

where $V_r$ is the volume fed per revolution;

$e$ is the offset distance (eccentricity, or half stroke length);

$R_m$ is the mean radius of the annular bed, or $(R_b - a/_2)$;

$h$ is the choke height;

$a$ is the annular width between the inner and outer walls;

$\theta$ is the angle of slope of the floor below the horizontal.

The mass feed rate is accordingly, for the solids contemplated herein, given by the following equation where $M_r$ is the mass per revolution:

$$M_r = 2\pi r\gamma_B (R_m - e)(h + a \tan\theta)$$

If we regard the small component of this feed which actually moves out of the bed in the filling stroke by virtue of the floor slope under the bed, merely as a relief for the choke effect and allow a first approximation, neglecting $e$ in relation to $R_M$, we have $$M_r = 2\pi e \gamma_B R_m h \quad (3A)$$

Grading

Another parameter which may be adopted in place of $\phi$, and furthermore affords important linking relationships with other important parameters is the grading factor P as applied to the solid material at the point of discharge. The grading factor expresses the ratio by weight or volume in a sample of the granular solid material between (a) the fraction which exceeds a first predetermined size (e.g. 1 inch) and (b) the fraction which is smaller than a second predetermined size (e.g., 3/8 inch) which would fit the interstitial voids of the first fraction. The ratio may be expressed for instance as +1/−3/8 (inch) or +25/ −10 (mm); another example of grading factor useful in coke assessment is +40/−10 (mm).

In the present description we assume for simplicity that the granular or nodular charge materials are homogeneous with respect to the specific gravity of the individual granules or nodules, so that P may be rendered equally by weight or volume; if mixed materials are treated, it is of course necessary to compensate accordingly.

Although the advantages of the present invention may be obtained with granular or nodular materials in general, they are secured to an increasing degree as the grading improves towards a single-size grading, i.e., approaches a high grading factor P.

Attention to measures which will increase the grading factor of the initial feed will therefore be beneficial to an important degree.

The effective angle of repose $\phi$ varies with the grading factor P in a manner which can readily be calibrated from observed analyses: with increasing grading factor the angle of repose decreases to values near 30°, with the corresponding reduction in bulk density due to increased voidage. The calibration is also illustrated in the accompanying drawings.

Accordingly the invention provides a method of operating annular bed apparatus of the type described, wherein the primary relationship (1) is fulfilled for a value of $\phi$ corresponding to the observed grading factor of the discharged material.

The grading factor expressed as +1/−⅜ (inch) gives a range of values from about 0.06 to 60, for graded material ranging respectively from aggregate to that for which $\phi = 30°$.

A useful relationship exists not only between P, $\phi$ and $\gamma_B$ as indicated, but also with $d_m$, the mean (granule or nodule) particle diameter in the charge material. The various relationships which can be established between parameters of the annular bed and of its operation, when in the critical mode, enable the designer or operator to determine any or all of them; the grading factor P is a most useful linking parameter of the charge material to be treated, in several such relationships as more fully set forth hereinafter.

Gas Flow

If the distribution and movement of granular or nodular solid material in a gas-solid contactor is not uniform it is impossible to provide uniform gas flow or uniform treatment of the solid by the gas. On the other hand, if a granular or solid material is distributed, and moves, in a uniform and regular manner in a descending bed, it is possible to approach substantially uniform treatment of the solid by updraught gas if the gas is supplied to the bed in a properly distributed way, so that true contraflow is obtained through the full height of the bed.

In the annular bed apparatus of the present invention, the bed extends by definition (corresponding to operational fact) from the top surface of the charge of material down to the choke interface. When the bed is operating in the critical mode, the solids flow determines the gas flow and the resulting gas flow is found to be remarkably uniform. Evidence of this aerodynamic levelling is found for instance in uniformity of product, such as pelletised coal carbonised to coke in an annular kiln operating in the critical mode; in the feasibility of correlation factors linking the gas pressure drop $\Delta p$ in the bed (total restriction R divided by bed height H)

and the grading of the solid charge, characterised for instance by a grading factor P or mean particle diameter $d_m$ or by $\phi$; and in the attainment of substantially equal temperatures at points across the bed width.

The bed of granular or nodular material, i.e. above the choke interface, is mobile, "live" and reaches maximum permeability to gas, during the filling stroke; during the discharge stroke, the bed material being static, its permeability to gas is lower. In this description, references to $\Delta p$ or R relate to the mean values for the whole annulus. It will be appreciated that although the bed rotates, the filling sector and discharge sector each remain oriented in one direction relative to the ground. It must be understood that unless the bed is actually rotating, the critical mode cannot be established and there is no possibility of achieving satisfactory gas flow.

During the filling stroke the pile of material on the floor is accelerated away from the choke interface with consequent reduction in bulk density whereas in the discharge stroke that part of the pile adjacent to the choke interface remains virtually static (in relation to the bed). The point of entry for gas is normally the solids discharge aperture but it could be supplied additionally through a suitable inlet or burner in the roof of the dome; in any event the gas, whether supplied under pressure or induced by suction, is first confronted by the crater slope of the pile of solid granular or nodular material. The shortest path to the outlet at the top of the bed would take the gas close to the choke, but because the acceleration of the pile away from the choke interface lowers the local bulk density, i.e. opens up that part of the pile, an effect is produced of a "plenum" chamber into which gas readily flows and equalises across the bottom of the bed. From all points on the botton of the bed (as defined herein) the paths to the surface are equal with no preferred channels except for relatively minor wall effects. The result is as if the gas had been supplied through a multichannel spreader or distributor designed to emit gas at a uniform pressure into all parts of the filling sector of the bed bottom ($\gamma = 0°$ to $180°$).

Gas permeability and uniformity is further assisted by the fact that, because of the plenum effect, the charge material descending from the annular bed towards a retreating surface of the pile, is also falling against the upcoming gas stream which may well represent the same order of mass flow rate as that of the solid charge; consequently the dust entrapped in the bed must be held at the upper surfaces of the interstitial voids in the bed, not only improving permeability but encouraging the maintenance of the true angle of sliding friction $\phi$ at the choke interface. In ways such as this operation within the critical mode tends to sustain itself whereas by contrast, departure from the critical mode tends to worsen automatically; the 10 percent permitted increase in choke height above the value satisfying primary relationship (1) fairly represents the cross-over point between those opposed tendencies.

The readiness with which uniform gas behaviour can be attained is, of course, to some extent dependent upon good grading (high P value) but the annular bed in the critical mode performs better than other types of bed even with badly degraded material.

Operation in the critical mode renders possible the correlation of gas flow directly or indirectly with all other parameters of the bed. This may be achieved in various ways ascertainable in principle from case to case but applicable only by virtue of the uniform nature of the flow. For instance, in the majority of uses envisaged for such annular bed apparatus, the treating gas will be supplied at temperatures substantially within the range from 800° to 900° C., and for a typical gas composition it is found that the following relationship agrees with observed data from annular bed plants of the most widely varied sizes and throughput rates:

$$\frac{R}{HG_A^2} = \frac{6.2 \times 10^{-3}}{5.93\sqrt{P}} \qquad -(5A)$$

where R is the gas flow restriction in the bed, in inches (water gauge);

H is the height of the bed, in inches;

$G_A$ is the mass gas flow per unit area, in pounds per minute per square foot (of annulus cross-section);

P is the grading factor, + 1 inch/− 3/8th inch.

($R/H = \Delta p$)

The following Table 1 shows a comparison of calculated values with actual values obtained with a variety of granular solids such as iron ore, and cement, at various gradings. The numbers given in the first column refer to the numbered curves in FIG. 11, and the actual values correspond with FIG. 17, both described later herein.

TABLE 1

| No. | P | Actual | Calculated |
|---|---|---|---|
| 1 | 0.076 | 1.0 | 0.950 |
| 2 | 0.42 | 0.734 | 0.728 |
| 3 | 4.5 | 0.475 | 0.475 |
| 4 | 12.5 | 0.402 | 0.402 |
| 5 | 60 | 0.308 | 0.308 |

Although satisfactory for most practical purposes, the approximation involved in the correlation (5A) causes a noticeable deviation in some cases, particularly in the region of the dotted lines in FIG. 17. A better approximation is obtained in the following correlation in the derivation of which the Reynolds Number has been taken into account:

$$\frac{R}{H} = \frac{186 \,.\, W_t^{1.33}\, \nu_t^{0.67}}{d_m^{1.67}} \times 10^{-3} \qquad -(5B)$$

where

R is the gas flow restriction,

H is the bed height, and $R/H = \Delta p$ is measured in inches water gauge per inch of bed or in centimetres water gauge per centimetre of bed;

$W_t$ is the superficial gas velocity in meters per second at temperature $t$, in this case taken as 800° C.;

$\nu_t$ is the kinematic viscosity of the gas at temperature $t$, taken as 800° C.;

$d_m$ is the mean particle size of the solid charge material, in metres.

This relationship (5A) can be expressed in the form:

$$R/H = k_1 \,.\, W_t^{1.33} / d_m^{1.67} \qquad -(5C)$$

where $k_1$ is a constant which can be determined for the given gas.

By way of example, and using the relationship illustrated in FIGS. 13 and 16 between P and $d_m$, explained later herein, we find that for nodular cement-making materials, in an annular kiln supplied with gas at the rate of 0.71 metres/second at 800° C., $\nu_t$ being $140 \times 10^{-6}$ m²/sec, for material of relatively poor grading, P = 1.0; R/H = 0.912 cms/cm. or ins/in; for material of above average grading, P = 10.0; R/H = 0.520 cms/cm. or ins./in.; for material of good grading, P = 60; R/H = 0.294 cms/sm. or ins./in.

It will be noted that relationship (5A) is expressed in terms of British units of measurement whereas relationship (5B), (5C) is based on metric units. For purposes of conversion, 0.71 kg/sec/m² = 10 lb/min/ft²; and in the case of typical combustion gas used in kilns, at 800° C., one kg/sec/m² corresponds to one metre per second.

A graph of relationship (5B) or (5C) showing R/H versus $W_t$ between logarithmic co-ordinates provides a group of parallel lines, each for a particular grading factor P (corresponding to a particular value of $d_m$), which agree very well with data observed on a wide range of sizes of bed and rates of throughput.

The following comparison in Tables 2 and 3 between two operational runs in the same annular kiln shows not only close agreement between actual values of R/H and those calculated from relationship (5B), but also the sharp deterioration in R/H when the kiln departs from the critical mode.

TABLE 2

Conditions:

Operating in critical mode; tan $\phi$ = h/a.
Output = 22–23 tons per hour, clinker.
Mass gas flow G = 2000 lb/min.
$G/_A$ = 8.3 lb/min/ft.² (A = annulus area)
$W_t$ = 0.59 m/sec.
$\nu_t$ = 140 × 10⁻⁶ m²/sec.

| Hours from start | P +1″/−⅛″ | Mean lump diameter $d_m^{1.67}$ millimeters | R (actual) ins. water | Restriction,R/H ins/in or cms/cm Actual | Calculated |
|---|---|---|---|---|---|
| 3 | 2.6 | 9.1 | 6.6 | 0.275 | 0.275 |
| 5 | 2.3 | 8.9 | 6.9 | 0.288 | 0.282 |
| 10 | 2.1 | 8.0 | 7.5 | 0.313 | 0.313 |
| 15 | 1.8 | 7.5 | 8.0 | 0.334 | 0.334 |
| 20 | 1.7 | 7.1 | 8.7 | 0.363 | 0.352 |
| 30 | 1.4 | 6.0 | 9.9 | 0.412 | 0.418 |
| 35 | 1.2 | 5.2 | 10.5 | 0.438 | 0.480 |
| 40 | 1.1 | 4.9 | 11.1 | 0.462 | 0.510 |
| 50 | 1.0 | 4.5 | 12.3 | 0.512 | 0.556 |
| 60 | 1.0 | 4.5 | 13.5 | 0.562 | 0.556 |

$$R/H = \frac{2500 \times 10^3}{d_m^{1.67}} \quad \text{ins/in.}$$

TABLE 3

Conditions:

tightness at choke, excessive compaction;

$h <$ a tan $\phi$, not in the critical mode; Output: 17–19 tons per hour clinker Mass gas flow G = 1900 lb/min.; G/A = 7.9 lb/min/ft²; $W_t$ = 0.56 m/sec; $\nu_t$ = 140 × 10⁻⁶ m²/sec.

| Hours from start | P +1″/−⅛″ $d_m^{1.67}$ | Mean lump diameter ins. millimeters | R (actual) water | Restriction,R/H ins/in or cms/cm Actual | Calculated |
|---|---|---|---|---|---|
| 3 | 2.1 | 8.3 | 11.4 | 0.518 | 0.278 |
| 5 | — | — | 11.6 | 0.526 | — |
| 10 | 2.0 | 8.0 | 12.1 | 0.550 | 0.288 |

-continued

| Hours from start | P +1″/−⅛″ $d_m^{1.67}$ | Mean lump diameter ins. millimeters | R (actual) water | Restriction,R/H ins/in or cms/cm Actual | Calculated |
|---|---|---|---|---|---|
| 15 | 1.7 | 7.1 | 12.6 | 0.573 | 0.324 |
| 20 | 1.8 | 7.3 | 13.1 | 0.596 | 0.316 |
| 25 | — | — | 13.6 | 0.619 | — |
| 30 | 1.3 | 5.6 | 14.1 | 0.640 | 0.410 |
| 35 | — | — | 14.6 | 0.664 | — |
| 40 | 1.1 | 4.9 | 15.1 | 0.687 | 0.470 |
| 45 | — | — | 15.6 | 0.709 | — |
| 50 | 1.0 | 4.9 | 16.5 | 0.750 | 0.470 |

$$R/H = \frac{2300 \times 10^{-3}}{d_m^{1.67}} \quad \text{ins/in.}$$

Comparison of the respective R/H values shows a consistent approximately 50 percent increase in gas restriction due to tight feeding and choke compression effects, over that appropriate to the critical mode.

The invention is further illustrated with reference to the accompanying drawings, in which:

FIG. 9 is a graph showing log (bulk density) against log tan $\phi$;

FIG. 10 is a graph showing bulk density against tan $\phi$;

Figure 1:
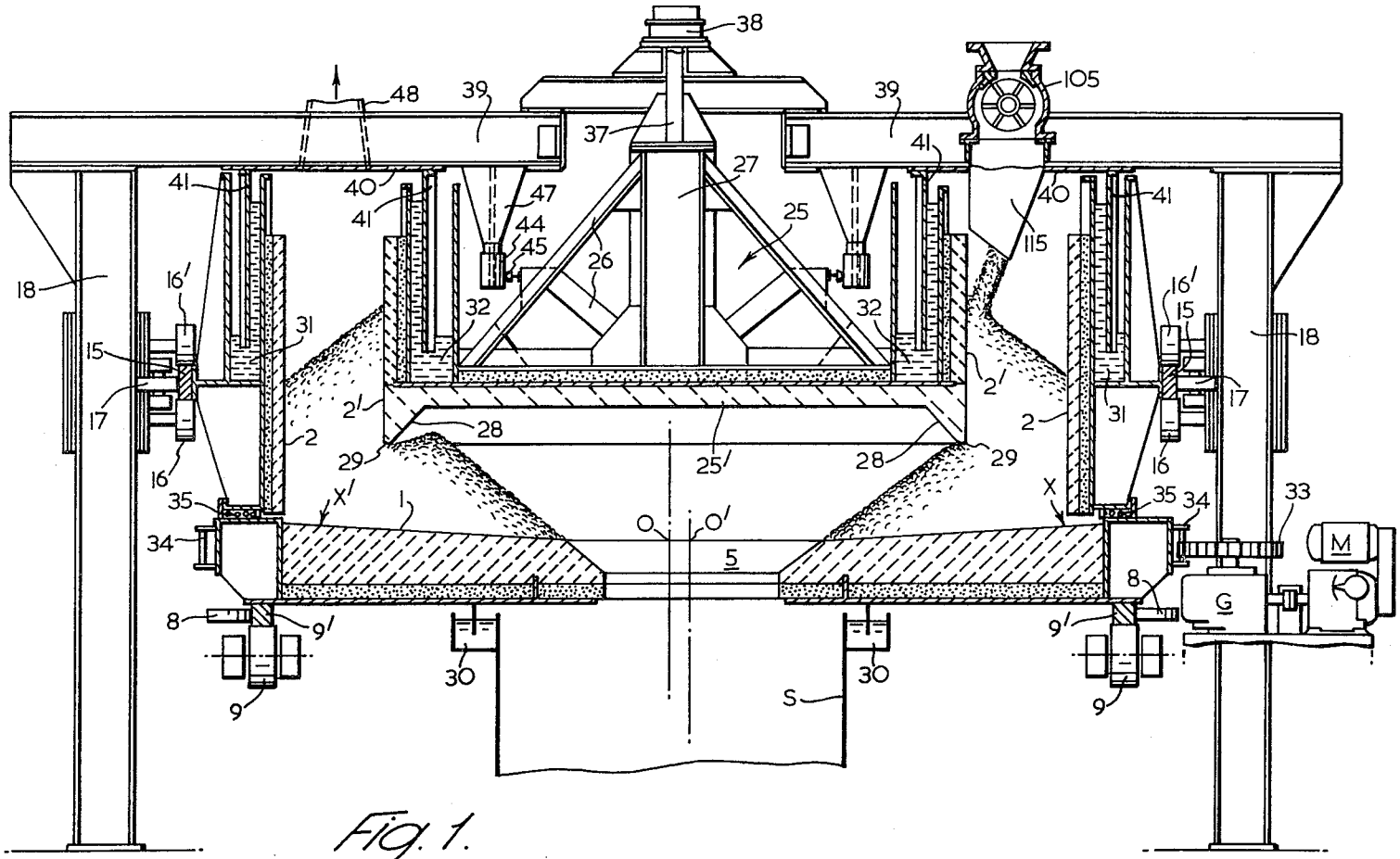
FIG. 1 is a cross-sectional side elevation, taken in the plane of the offset axis, of an annular kiln in which the invention may be practised.

Referring to FIG. 1 the apparatus shown therein comprises an annular floor or hearth 1 of refractory material supported on a base plate, constituting the hearth of an annular processing chamber generally indicated at 24 which is defined by outer and inner wall parts 2 and 2′ respectively, and through which solid granular or nodular material to be dried, heated, cooled or otherwise processed, is passed. The floor or hearth 1, the inner wall 2′ and the outer wall 2 are separately mounted for rotation, the hearth about an axis $x$ and the walls about an offset axis $y$.

The chamber 24 is closed at the top by a stationary annular cover plate 40 secured to the superstructure 39 which is supported by uprights 18.

The cover is arranged to close the chamber in an air tight manner by means of downwardly depending flanged plates 41 which extend into the liquid-filled troughs 31 and 32, which are built in respectively to the wall structure of the outer and inner walls 2 and 2′. Overhanging guard plates may be provided if desired, to minimise loss of sealing medium by evaporation in the event of it being a liquid, and to exclude the ingress of dirt and dust. Liquid, preferably water, for the sealing troughs 31 and 32 is constantly supplied by pipes to maintain the troughs filled to the level of overflow pipes which discharge into a drain trough (not shown) secured to the uprights 18 of the superstructure.

The hearth 1 is built on a frame which on its underside is provided with a circular running band or track 9′, by which the hearth is rotatably supported on a plurality of rollers, one of which is indicated at 9, mounted to revolve in brackets (not shown) supported on the floor. To confine movement of the hearth 1 to rotation about the axis $x$ a plurality of circumferentially spaced thrust rollers 8 are provided to engage the lateral wall of the band 9′. The rollers 8 are laterally adjustable by means of screws along radially aligned guideways (not shown).

The hearth 1 is arranged to be driven by means of an electric motor M driving through suitable reduction gearing G, a pinion 33 which meshes with a toothed driving band 34 on the outer perimeter of the hearth 1.

The outer wall 2 is provided with a tyre 15 by which it is rotatably supported on rollers 16 mounted on the uprights 18 to revolve on radially aligned horizontal axes. Means (not shown) incorporating screws are provided to enable the rollers 16 to be vertically adjusted. Movement of the outer wall 2 is confined to rotation about the $y$ axis by lateral thrust rollers 17, and upward movement of the outer wall is prevented by engagement on its upper side with a second set of rollers, 16′.

The inner wall 2′ is united with a roof structure 25 which spans the centre of the hearth to define and enclose a space thereabove. The roof structure comprises a framework 26 lined on its underside with refractory material 25′, and suspended by a central tubular rod or king-pin 27 which is attached to a spindle 37 suspended to revolve in a central bearing 38. The bearing 38 in turn is carried by the superstructure 39. Thrust rollers 44 mounted to revolve about vertical axes on a series of circumferentially spaced brackets 47 depending from the superstructure 39, engage a circular rail 45 fast with the framework 26 of the roof structure, to ensure that the roof structure rotates about the axis $y$ and is prevented from excess lateral movement.

Material to be treated is supplied to the processing chamber 24 via a valve device 105 mounted over an aperture in the cover 40. The apparatus is depicted as a cross-section on the offset axis, so that in fact the valve will not be in the position shown but in a corresponding position rotated behind the plane of the drawing about 90° about the axis $y$. The material is fed in through a chute 115 to deflect the material towards the inner wall 2′ and allow it to build up into a bed supported by the hearth 1 and contained between the walls 2 and 2′ as described in the foregoing general description.

No provision is made for positively rotatably driving either the inner wall 2′ or the outer wall 2. When the apparatus is in use, as already explained, and the chamber 24 filled with material, drive will be transmitted to the walls by the charge material in contact therewith and resting on the hearth which will be driven in rotation.

Upon such rotation, as explained at the outset, due to the offset between the axes $x$ and $y$, the hearth and chamber rotate eccentrically with the result that material is continuously peeled off the bed on hearth 1 and passes out through a central discharge opening 5 provided in the hearth 1 and concentric therewith.

Processing gases, for example hot gases issuing from a kiln, are supplied to the apparatus via a shaft S, through the discharge opening 5, a liquid or other suitable seal being provided between the shaft S and the hearth 1 as indicated at 30. A further seal is provided between the lower end of the outer wall 2 and the hearth 1 as indicated at 35. From the space above the hearth enclosed by the roof structure 25, into which they are initially introduced, the processing gases are of course constrained to pass through the bed of material in contraflow thereto, the gases finally being withdrawn or allowed to escape from the processing chamber via one or more flues or ducts as indicated at 48 for convenience although they will not in practice be over the offset axis.

It will be seen that by the provision of a stationary cover 40 for the processing chamber 24, independent of the main roof structure 25, the framework 26 of the latter and the upper surface of the roof proper, is open to the atmosphere.

The roof lining 25′ has a peripheral skirt portion 28 which provides for relief where solid charge material should rise after leaving the choke point located at 29.

Further details of the structure and significance of parts of the apparatus of FIG. 1 will become apparent from the following description of the other Figures. It will be appreciated that in order to provide for adjustments in operation, there should preferably be provided screw means or other suitable devices, for raising or lowering the roof 25, and for increasing or decreasing the offset $xy$, in a continuously controlled manner; as well as bed level detection means to sense the level of the top of the bed, most preferably associated with bed level recording means.

The positions X, O, O′ and X′ are explained in connection with FIG. 2.

Other embodiments of apparatus which may be employed in the practice of the present invention are illustrated in the above mentioned British Patent Specification 1,059,149 and U.S. Pat. No. 3,331,595; it must be borne in mind, however, that such apparatus can be used only if it is constructed so that (a) the inner wall, outer wall and hearth are independently rotatable, and (b) the dimensions are capable of fulfilling the conditions set by the primary relationship (1).

Figure 2:
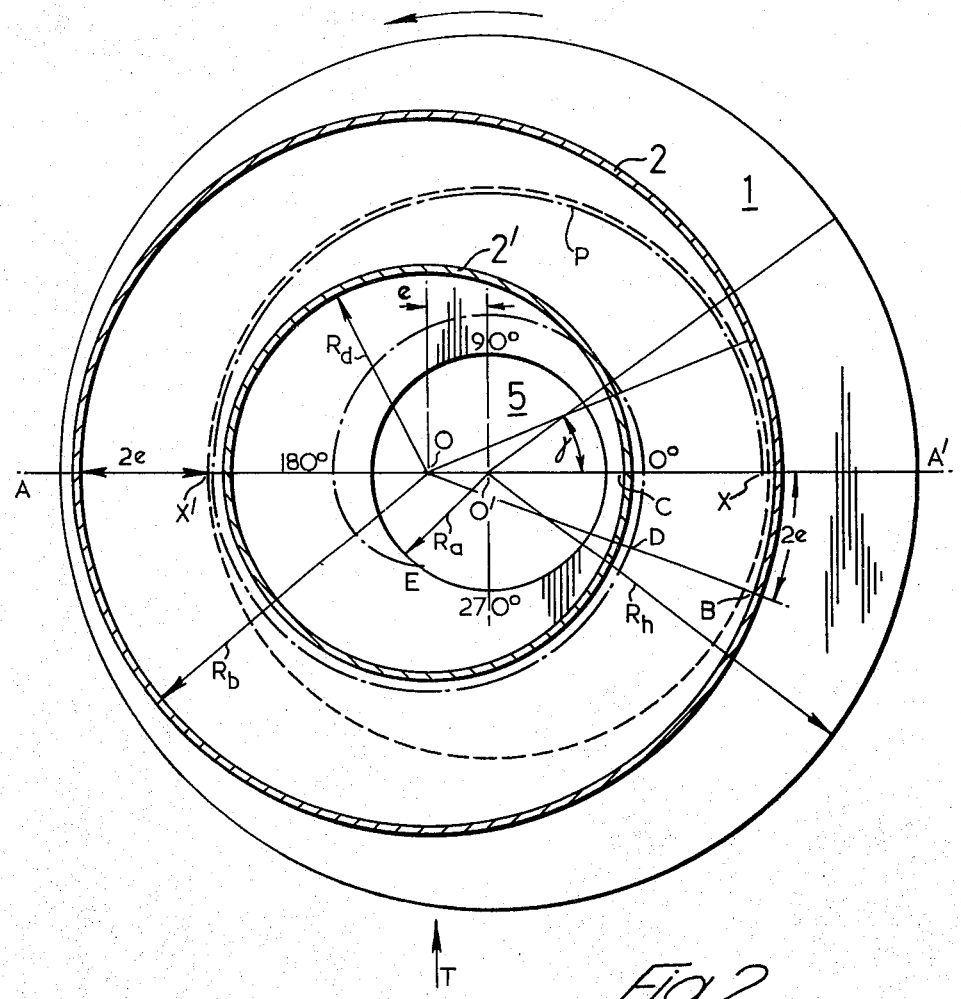
FIG. 2 is a schematic plan view of the three major components of annular bed apparatus, i.e. floor or hearth, outer wall or bowl, and inner wall or dome, showing aspects of their relative motion, and of charge material therein in the critical mode.

In FIG. 2, there is represented in plan the circular floor or hearth 1 of an annular bed apparatus useful in the invention, with a concentric discharge aperture 5, the centre of the hearth being at 0'. The outer wall 2 and the inner wall 2' of the annulus are centred on 0.

The radius of the hearth 1 is shown as $R_h$, the radius of the outer wall 2 as $R_b$ (bowl), and the radius of the inner wall 2' as $R_d$ (dome) and the radius of the discharge aperture 5 as $R_a$.

As the hearth 1 rotates in the sense indicated by the arrow, it revolves through an angle measured by $\gamma$. The angle $\gamma$ is shown as representing either the rotational position of hearth 1 or of the outer wall 2, regardless of the discrepancy due to the offset distance $e$ between the respective centres 0, 0', because the value of $e$, exaggerated for clarity in the drawing, is in practice small in relation to $R_h$ and $R_b$, so that for instance the respective positions $\gamma = 270°$ on both floor and wall are in fact substantially the same. OO', or AA', is the offset axis.

During rotation of the charged apparatus, a point on the surface of floor 1 at X on the offset axis immediately under the outer wall 2, i.e. at $\gamma = 0°$, will pass round to point X', i.e. at $\gamma = 180°$, as the floor rotates through 180°. This semi-circular pass indicated by the dotted line is the filling stroke during which the floor withdraws radially inwards from under the wall 2 so that X' at $\gamma = 180°$ is a distance $2e$ from the wall 2. Material resting on the floor is carried inwards on the floor at a radial velocity which in the critical mode increases and decreases as already described under "Withdrawal Action," reaching a maximum at $\gamma = 90°$.

During further rotation through a semicircle, the point at X' returns to X, now undercutting material resting on the floor because the material revolves in this half circle about centre 0, under the constraint of the bed behind it, instead of about centre 0' and in so doing, either in the same revolution or a later one, reaches and drops through aperture 5. Thus, solid material which descended through the bed close to the outer wall 2 and has arrived at point X on the floor, will proceed without undergoing any sudden change in momentum, along a path P until it reaches the discharge aperture. Owing to a distortion effect of the exaggerated $e$ in the drawing, and also because no allowance has been made for slip in drawing this locus which centres about 0 and 0' in alternate semicircles, the discharge point happens not to be at or near $\gamma = 270°$ position where in practice, in the critical mode, it would most probably be.

In fact, in the critical mode, when the point on the floor 1 has travelled once from X, through X' and back to X, it will be found that the point on the outer wall 2 which was at X at the start of this revolution has by the end of the same single revolution of the floor through 360°, only reached B, which represents circumferentially measured lag of $2e$ of the wall, behind the floor. In the same revolution a corresponding point on the inner wall 2', starting on the offset axis at C, would only reach the point D.

By reference to FIG. 1 it will be seen that, as viewed in a vertical cross-section that moves round with the apparatus, the movement of any given granule or nodule in the charge material relative to the apparatus, will be a descent down the vertically extending bed, followed by passage in a more or less horizontal direction over the floor; the path of the material thus turns through 90° in the region of the choke. It is important to realise, however, that the situation is not that of granular materials passing round a right angle bend in a pipe, but of granular materials in paths undergoing a smooth directional transition, the angle of deviation at any given point not being more than $\tan^{-1}(e/R_d)$.

It will be appreciated from FIG. 2 that a granule descending in the bed thereby describes circles about 0; on reaching the floor (or, more generally, the choke interface) in a filling stroke the granule begins to describe a circle about 0' until it crosses the offset axis whereupon it reverts to a circular path about 0 of smaller radius than its previous circle about 0. The granule is thus subjected to steps of increasing radial acceleration when it reaches the choke, the change of acceleration being relatively slight, and giving rise only to a small angle of inflexion in the path even at the maximum position ($\gamma = 90°$). Moreover the angle of approach between the granule and the floor (or material resting on the floor) is very shallow, being proportional to $2\,e \tan \phi$ divided by the circumference of the apparatus.

In the critical mode, the maximum lateral thrust on the outer wall bears a linear relationship to the charge weight and should be found at T, i.e. where $\gamma = 270°$. The movement of the line of maximum thrust can be readily determined in stereogrammetric manner by means of two or more thrust meters placed at suitable peripheral points. In annular bed apparatus departing from the critical mode, the line of thrust not only moves round towards the $\gamma = 360°$ position but increases steeply to values which may be of the order of ten times the optimum value. If the thrust line moves round as far as the offset axis, the actual offset may be cancelled out by the distortion of the machine towards a concentric condition, with consequent loss of feed.

In spite of tilting of the inner wall in response to thrust forces within the critical mode, $\phi$ may be taken in any radial vertical plane.

Figure 3:
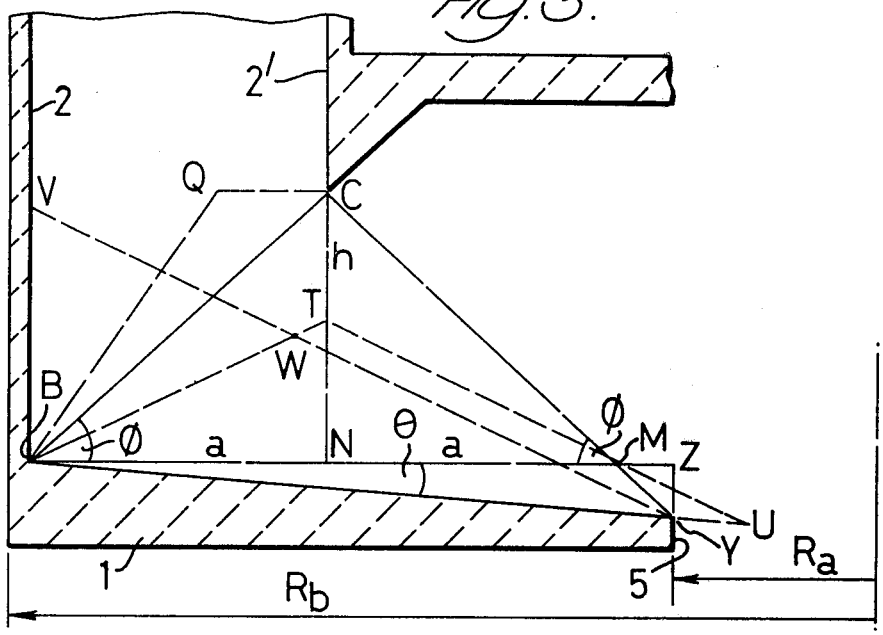
FIG. 3 is a schematic vertical section through the choke region of annular bed apparatus, useful in establishing the stability criterion (2) in the critical mode.

FIG. 3 shows the geometrical relationships which determine the maximum discharge aperture diameter according to the stability criterion (2). The figure represents the region of the choke in apparatus such as that of FIG. 1, in vertical radial cross-section, at the $\gamma = 0°$ position, where the discharge aperture 5 is nearest to the inner wall 2', during operation in the critical mode.

In FIG. 3, BZ represents the horizontal from the floor periphery at B (more strictly the outer wall bottom). CY represents the vertical choke height ($h$) and BN represents the annular width ($a$). The angles of repose $\phi$ (NBC) and (NMC) are assumed to be equal. The error due to this approximation lies in the direction of smoother and more stable operation. The distances BN and NM are therefore each equal to ($a$). The floor slope angle is $\theta$ to the horizontal. .

Hence:

$$MY = \frac{2a.\sin\theta}{\sin(\phi - \theta)}$$

$$MZ = MY.\cos\phi$$

and $R_a + e < R_b - BZ$ if the bed is to be stable.

whence $$R_a + e < R_b - 2a \left(1 + \frac{\sin\theta.\cos\phi}{\sin(\phi - \theta)}\right)$$

where $R_a$ = radius of discharge aperture, $R_b$ = radius of outer wall, $e$ = offset distance.

The degree of offset $e$ is limited by the stability criterion for a given value of $R_a$; however, because $\phi$ (NMC) is in practice greater than $\phi$ (NBC), and $e$ is small in relation to $R_a$, we have as an approximation:

$$R_a < R_b - 2a \left(1 + \frac{\sin\theta.\cos\phi}{\sin(\phi - \theta)}\right) \quad -(2)$$

Stability in respect of operational characteristics is also favoured by adopting a bed height H measured vertically from the choke interface BC to the bed top parallel to BC, of at least $h \cot\phi$ ($=a$) or more preferably 2h.

In the event (A) that $R_a$ is too large in relation to $\phi$, a condition of running off sets in, illustrated in FIG. 3 in broken lines. If the angle of repose $\phi$ becomes equal to angle NBW, then the slope of the top of the pile down to the aperture will become WY, so that material which is in the bed above the line VW will slide off, for instance along the line TMU, and fall through the aperture 5. In this manner the material in the bed flows out at an excessive and uncontrollable rate, not in the critical mode; running-off occurs more or less all round the periphery of the discharge aperture, creating a rotating funnel of falling material. This condition can only be cured by lowering inner wall 2'.

FIG. 3 also illustrates the tight choke condition brought about (B) when $h$ is not high enough in relation to $\phi$. If $\phi$ becomes the angle NBQ, for instance by the introduction of degraded material, it will be found that charge material remains static above the level QC against the inner wall 2'. This behaviour is consistent with a migration of the choke point C to the point Q, with a choke transfer mechanism operating as already described above and further illustrated in FIG. 4, but on the basis of a choke interface at BQ instead of BC, so that the machine feeds only across the line BQ. When the floor moves to the right, as in the filling stroke, there is no way for material above QC to descend.

As a result, compression of the charge occurs in the choke region, the feed rate falls severely and the apparatus departs from the critical mode with the results hereinbefore enumerated, such as the migration of the maximum discharge point and maximum lateral thrust line from $\gamma = 360°$. The dead area above QC rapidly becomes solid with dust and other debris as the gas flow fails in that region, and the restriction R/H becomes relatively higher. This condition can only be cured by raising the inner wall 2'.

Under condition (A) or (B) the conditions for proper heat exchange between gas and solid are contravened.

Figure 4:
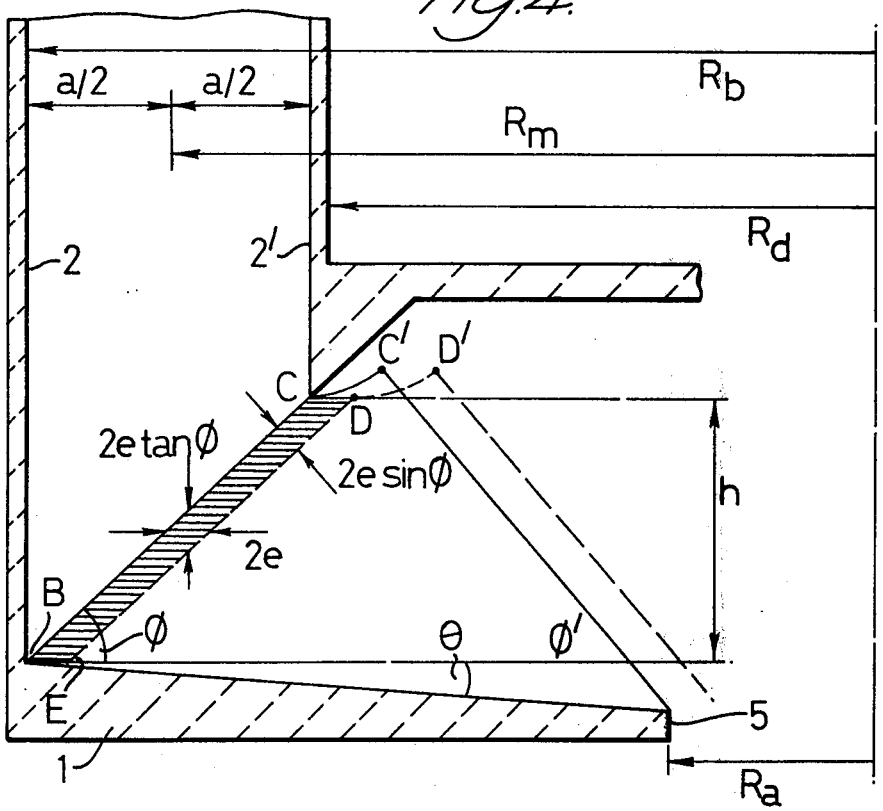
FIG. 4 is a schematic vertical section through the choke region of annular bed apparatus, useful in establishing the feed rate relationship, in the critical mode.

FIG. 4 illustrates the derivation of a feed rate equation. It is postulated that material at the choke interface BC as described with reference to the choke transfer mechanism, is drawn during one revolution (actually in the filling stroke) of the floor through a stroke length 2e to the position ED. Put another way, the cross-section of the layer peeled off the bed in one revolution (as described under "Withdrawal Action") is parallelogram BCDE.

Figure 7:
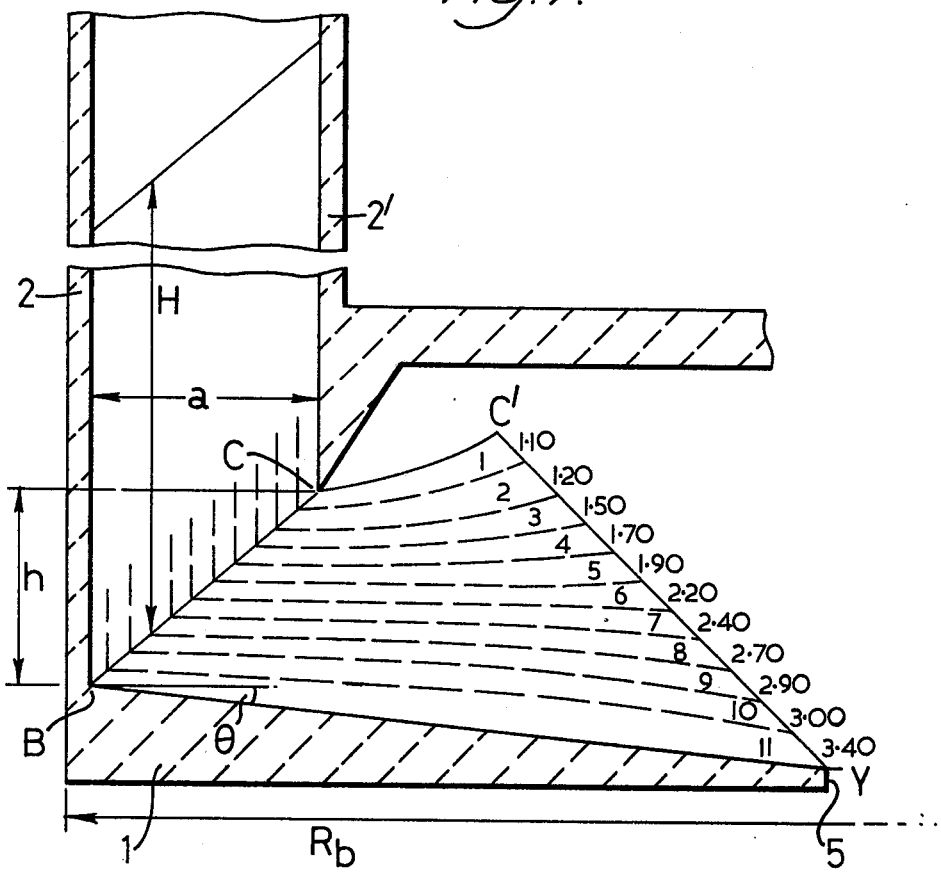
FIG. 7 is a schematic vertical section through the choke region illustrating the movement of a pile of material on the annular floor in the filling stroke, in the critical mode.

In practice, as more fully illustrated in FIG. 7, material at C will rise along line CC' during the filling stroke because of the effects of the angular constraint suffered by the material while advancing radially towards one centre. The error introduced over the relatively short length 2e may be ignored, but because of the angular constraint effects, the position D' reached by material from C in two revolutions of the floor will be higher than C'; depending on $R_a$, i.e. on the floor width, the material over the floor will require a greater or lesser number of revolutions of the floor in order to reach the fall-off position on the slope down to the aperture 5. Nevertheless the feed rate will be the same, as already discussed, regardless of $R_a$ as long as the latter is not too big or too small. Consequently the dimensions of the quantity of material which slides off the pile into the discharge aperture 5 in one revolution of the floor cannot be directly ascertained. In fact the quantity must be the same as that which passes across the choke interface.

$R_m$, the mean annular radius is equal to $\frac{1}{2}(R_b + R_d)$ where $R_b$ is the outer wall radius and $R_d$ is the inner wall radius.

It must be remembered that the volulme fed across the choke interface, or the layer of cross-section BCDQ, is only semicircular per revolution of the floor (as a result of the respective filling and discharge strokes). The volume of the frusto-conical semi-ring of cross-section BCDE can be ascertained in various ways, e.g. as half the product of the area of the choke interface $\pi S(R_b + R_d - e)$ where S is the length BD = h/sin $\phi$, and the layer thickness $2e \sin\phi$; or as half the product of the mean circumference $2\pi(R_m - e)$ and the layer cross-sectional area $2eh$, or by integration for a ring volume from 0 to $\pi$.

Accordingly the volume fed per revolution in the filling stroke, V, is:

$$V_1 = 2\pi e\, h\, (R_m - e)$$

Figure 5:
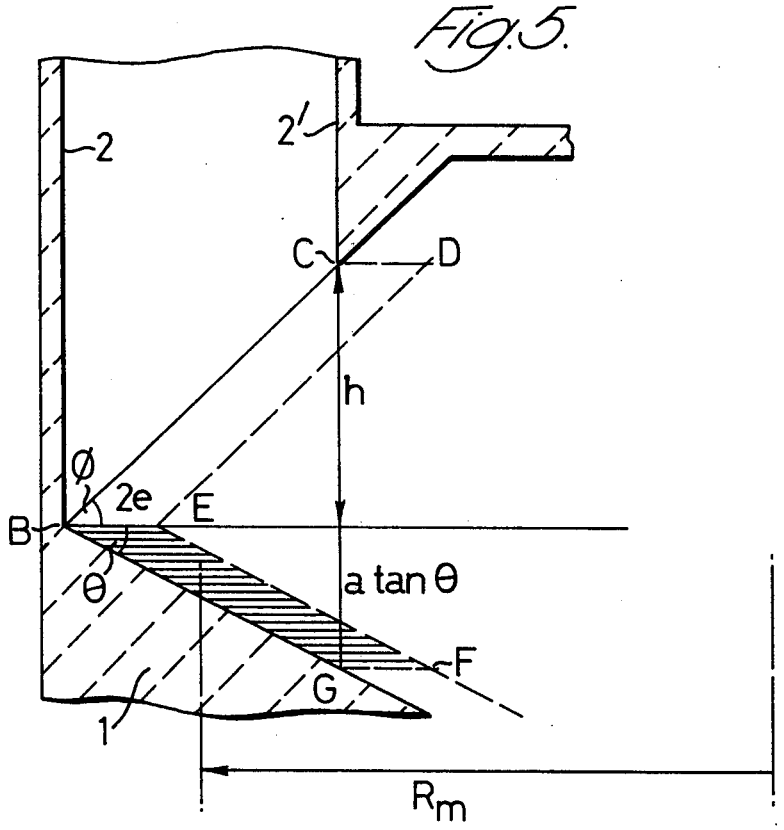
FIG. 5 is a modification of FIG. 4, useful in establishing the volume fed in the discharge stroke in the critical mode.

In FIG. 5, parts of FIG. 4 are shown with a highly exaggerated floor slope $\theta$. By geometry, from FIG. 5 following reasoning analogous to that relating to FIG. 4, it is evident that a small volume $V_2$ is fed past the choke interface during the discharge stroke. This volume $V_2$ helps to relieve the choke and has a layer cross-sectional area BEFG, given to a close approximation by:

$$V_2 = 2\pi e\, a \tan\theta\, (R_m - e)$$

Summing the equations for $V_1$ and $V_2$ and ignoring any effect of slip we obtain the Reed Rate Equation already stated:

$$V_r = 2\pi e\, (R_m - e)(h + a \tan\theta) \quad -(3)$$

or $$M_r = \text{approximately } 2\pi e\, h\, \delta_n\, R_m \quad -(3A)$$

When operating in the critical mode it is found that the relationship between ingoing feed rate and floor revolution rate is linear for various offset distances; and the slopes of this relationship when plotted against $e$, also produce a linear graph.

Figure 6:
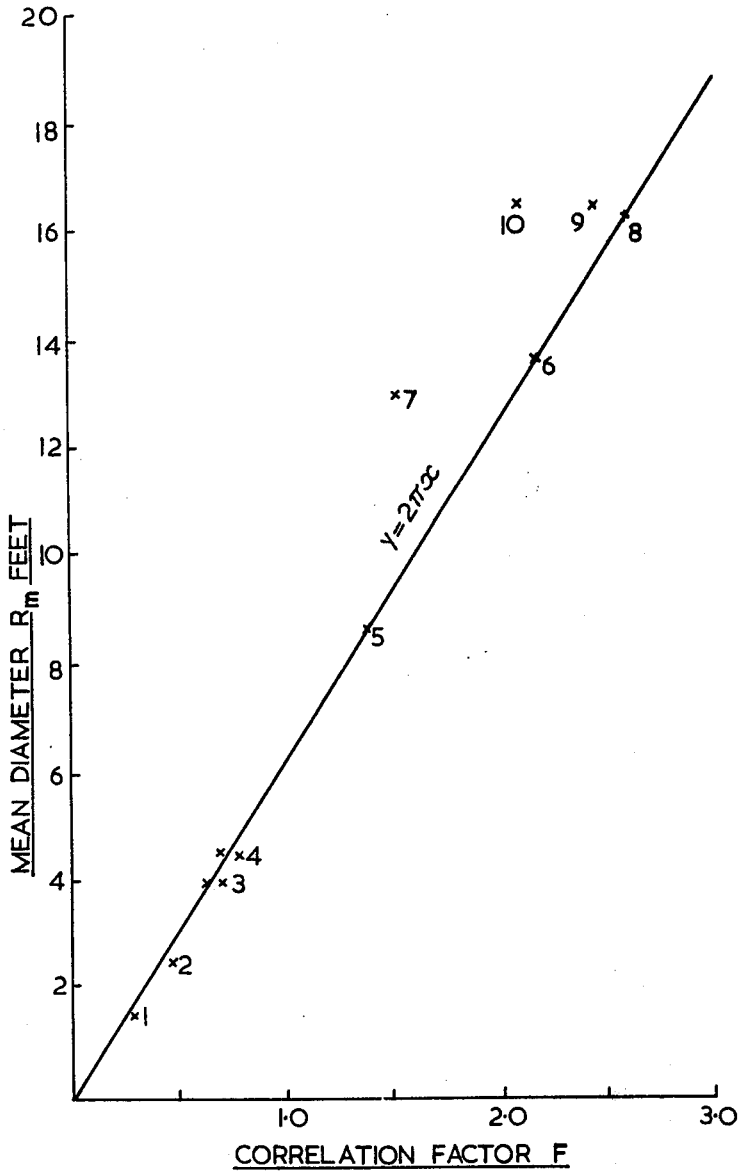
FIG. 6 is a graph showing observed data from a wide range of annular kilns in the critical mode, in relation to a line representing feed rate relationship (3)

FIG. 6 shows the close agreement found in practice over the widest possible range of bed capacities, between actual feed rates and those calculated from equation (3A). In FIG. 6 the mean annulus diameter given in terms of the radius $R_m$ in feet is plotted against a correlation factor F. Now the feed rate equation (3A) is of the form $y = 2\ \pi x$ where $x$ represents the mean radius and $y$ represents $M_r/e\ h\ \delta_B$, i.e. a linear equation of slope $2\pi$.

The numbered points on FIG. 6 were each obtained from operational data in various annular kilns of the type illustrated in FIG. 1 working on cement materials of approximately the same bulk density. For each case the slope of the linear relationship between the feed rate in tons of material per hour and the kiln speed in revolutions per hour was used to find the rate in tons per revolution, $T_r$. The relationship between $T_r$ and $e$ also being linear and $e$ being known, the value of $T_r/e$ was taken and divided by the known choke height (h) (measuring $e$ and $h$ in feet) to obtain correlation factor F in tons per square foot per revolution, which was then plotted against the known bowl radius. It was found that when the primary relationship was being observed, the points plotted agreed closely with a line of slope $2\pi$. It should be noted that for complete conversion to $y = 2\pi x$ ($y$ being the correlation factor) the substantially constant bulk density and the ratio of tons to pounds, must be taken into account.

The two points numbered 3, and the two points numbered 4, were in each case a pair of results for one particular kiln. The points numbered 9 and 10 record operation outside the critical mode with a tight choke ($h<a \tan \phi$) in the kiln for which the point numbered 8 represents critical mode operation. The point numbered 7 represents operation in a kiln the dimensions of which would not allow critical mode operation; after correction of the dome, operation represented by the point numbered 6 was obtained.

FIG. 7, again depicting the region of the choke in annular bed apparatus of the type illustrated in FIG. 1, indicates the rise of charge material crossing the floor to accommodate its decreasing circumferential dimension. The extent of the rise depends inter alia on the floor width, ($R_b$ - $R_a$) and on the initial height on the bed bottom BC and therefore on the radial position of a given element of charge material during its descent through the bed, as indicated diagrammatically by the broken lines separating the segments of charge material numbered from 1 to 11.

The actual movements of granules down the bed from initial positions on a radius of the bed, and thence over the floor, were determined by labelling the granules, by colouring them. The charge material could consequently be considered in incremental segments of equal height at the choke interface, as indicated in the Figure.

For an annular kiln operating with the dimensions given below, the numerals marked against respective segments down the slope of the crater C'Y indicate the mean path lengths found for charge elements from the bed bottom BC to the slide-off slope C'Y, for those segments, in feet.

| | | |
|---|---|---|
| Kiln dimensions: | | |
| Floor width, $R_b - R_a$ | = | 3.5 feet |
| Bed outer radius, $R_b$ | = | 4.5 feet |
| Bed inner radius, $R_a$ | = | 3.4 feet; a = 1.1 feet |

-continued

| | | |
|---|---|---|
| Choke height, h | = | 1.0 feet (poor grading, P<0.09, $\phi$ above 40°) |
| Offset, e | | 3.8 inches (high for kiln of this size : accentuates rise effect). |
| Bed height, H | = | 2.85 feet |
| Annular area of bed, A | = | 78 cubic feet (A × H) |
| Residence time in bed per hour feed rate. | = | 66 minutes at 4.2 tons |

The following Table 4 shows details of the calculation of variation in charge retention time.

TABLE 4

| Path | | Compressed Volume | Radial Feed Rate | Residence Time (mins) | | |
|---|---|---|---|---|---|---|
| No | Length in feet | Cu. Ft. | Cu. ft. per rev. | No. of revs. | Time across floor (mins) | Total in kiln (mins) |
| 1 | 1.1 | 1.15 | 0.575 | 2.00 | 12.4 | 78 |
| 2 | 1.2 | 1.25 | 0.593 | 2.10 | 13.0 | 79 |
| 3 | 1.5 | 1.57 | 0.612 | 2.57 | 15.9 | 82 |
| 4 | 1.7 | 1.77 | 0.630 | 2.80 | 17.3 | 83 |
| 5 | 1.9 | 1.98 | 0.647 | 3.06 | 18.8 | 85 |
| 6 | 2.2 | 2.30 | 0.667 | 3.46 | 21.4 | 87 |
| 7 | 2.4 | 2.50 | 0.685 | 3.65 | 22.6 | 89 |
| 8 | 2.7 | 2.80 | 0.703 | 4.00 | 24.8 | 91 |
| 9 | 2.9 | 3.00 | 0.721 | 4.17 | 25.8 | 92 |
| 10 | 3.0 | 3.13 | 0.740 | 4.22 | 26.2 | 92 |
| 11 | 3.4 | 3.55 | 0.758 | 4.70 | 29.1 | 95 |

The slope of the floor at $\theta$ to the horizontal has little or nor influence on the feed rate as such, in the critical mode, but it plays an important part in achieving the critical choke transfer mechanism with improved bed stability and minimised friction factor (and hence minimised power consumption by the offset action) in accordance with a relationship $f_\theta = F_o - b \tan \theta$ where $f_\theta$ = friction factor at a slope angle $\theta$ and $b$ is a constant which may be of the order of 1.37 for the material in question.

Moreover the slope $\theta$ assits granules or nodules in the charge to achieve the realignment necessary to accommodate the decreasing circumferences of their paths as they spiral towards the centre of the floor, and thus helps to sustain critical mode operation instead of the pushing action referred to earlier.

The ease and smoothness of the traverse across the floor is further assisted by the provision of a sharp choke point at C. Any tendency to flatness at C will introduce the horizontal component of choke action already referred to, with consequent compression of the charge tending to lift the roof at the choke to more than the 10 minutes or so of tilt expected in the critical mode, whereupon the floor width becomes a factor to be noted in the maintenance of the critical mode, i.e. $R_a$ should be as near as practical to the maximum permitted by the stability criterion (2). If $R_b - R_a$ is excessive, the charge material in a vulnerable hot condition is too firmly and for too long in contact with the roof before it can find relief and rise, the critical mode is lost and the charge material breaks down at an increasing rate because excessive angular compression increases $\phi$.

In the critical mode, the incremental feed rates of charge material with respect to radius of floor traversed, are linearly related, i.e. they are consistent with the feed rate equations.

Figure 8:
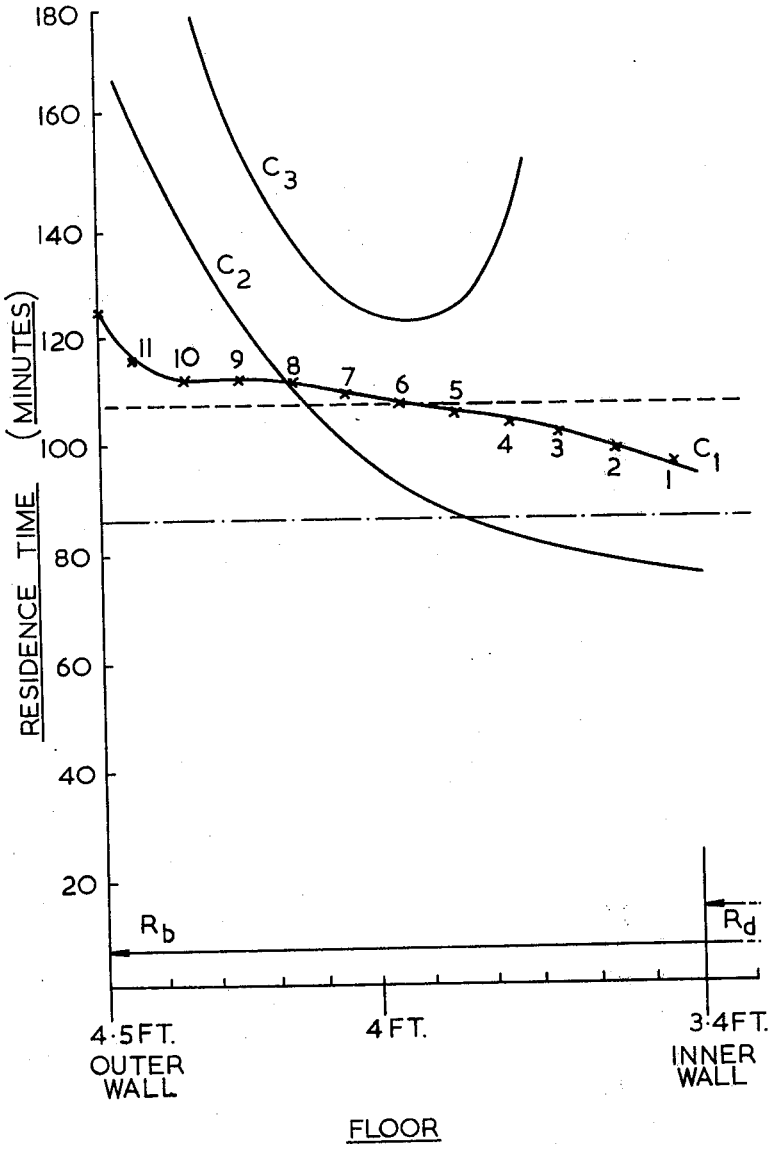
FIG. 8 is a chart showing residence time of charge material in an annular bed in relation to radial position in the bed, in the critical mode.

FIG. 8 shows the residence time of charge material against radial position in the bed, in the kiln and under conditions somewhat similar to those referred to in connection with FIG. 7. The residence time in the critical mode is indicated by the line C, through points obtained for numbered segments similar to those of FIG. 7. The area bounded between the line C, and the horizontal line at 87 minutes (representing the constant residence time during descent as far as the bottom BC, see FIG. 7) is accounted for by the movement of the charge over the floor after crossing BC. It will be seen that the residence time is not only quite uniform in the bed proper, but the general variation from the mean residence time at 107 minutes during the rest of its stay in the apparatus is not great in relation to the total residence time when compared to that in any other apparatus.

The curve $C_2$ represents the behaviour of an annular bed in a running-off condition (since the curve falls below the proper value for time spent in the actual bed) resulting in an increase in nominal feed rate of some 15 percent, more than half of the feed being non-uniformly treated and the rest under-treated.

The curve $C_3$ represents the behaviour of an annular bed in a tight condition ($h < a \tan \phi$) in which the feed treatment is entirely non-uniform, more characteristic of a prior shaft furnace, abnormally low and subject to blockage adjacent to the inner wall.

FIG. 9 shows the observed relationship between the logarithm of tan $\phi$ and that of the bulk density $\gamma_B$ of treated cement clinker-forming charge material of specific gravity 2.7, in pounds per cubic foot, from which $\phi$ can be ascertained for the purpose of maintaining critical mode operation. The bulk density is obtainable by comparing the measured volumetric and mass feed rates of the apparatus at any given time. On the other hand the bulk density can be ascertained from $\phi$ if known, or from the observed grading factor (and hence also from the gas flow and pressure drop in the bed).

FIG. 10 shows the curve corresponding to the line in FIG. 9, for $\gamma_B$ against tan $\phi$, obtained from mass and volumetric feed data on a range of pilot and full scale production plants. Scale adjustments of the bulk density by appropriate factors will enable the curve to be applied to materials of other specific gravities.

Figure 11:
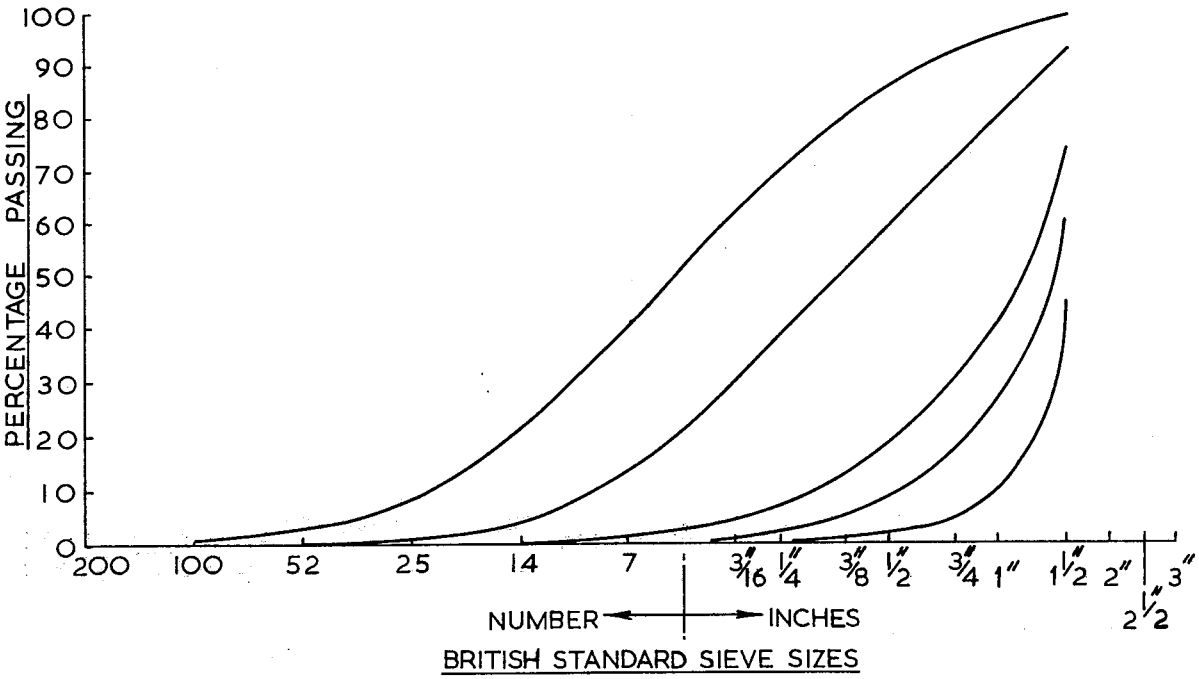
FIG. 11 is a chart of a series of five continuous gradings of granular material.
Figure 15:
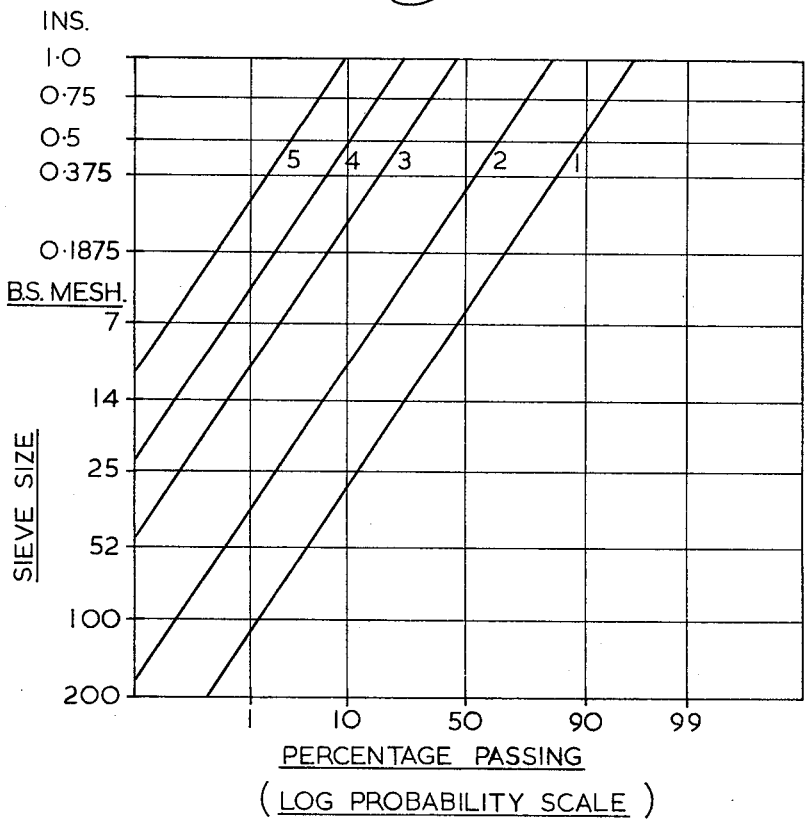
FIG. 15 is a chart of the series of five continuous gradings of FIG. 11 but on a logarithmic probability scale.
Figure 17:
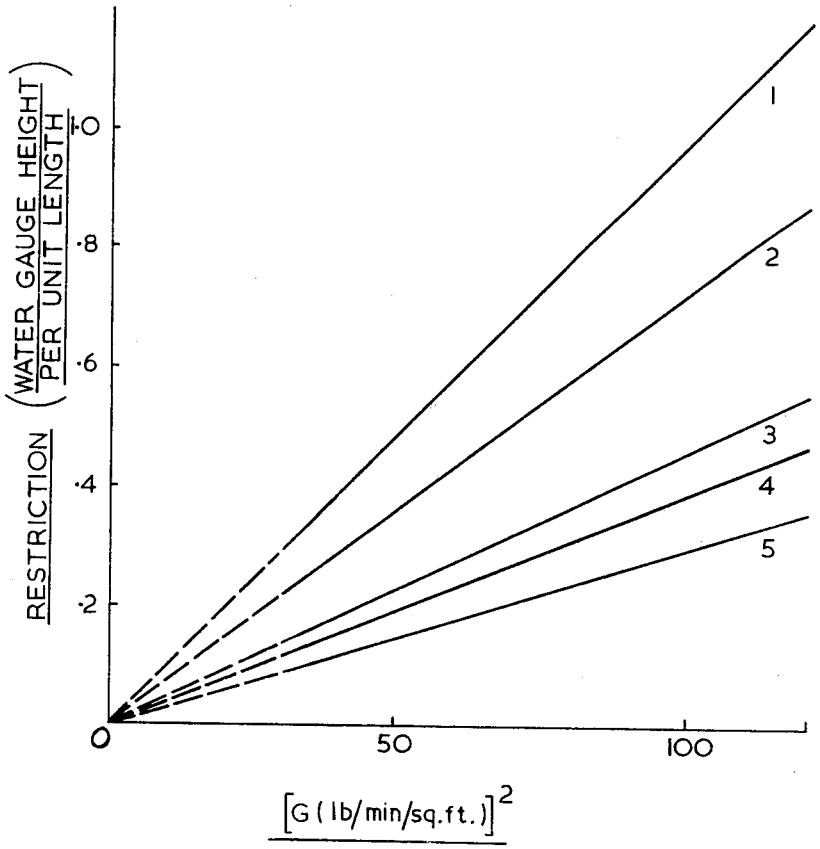
FIG. 17 is a graph between linear co-ordinates showing gas restriction against mass gas flow at various grading factors, in the critical mode.

FIG. 11 shows the particle size analysis or grading curves for 5 continuously graded granular or nodular materials discharged from an annular kiln. Reading from left to right these curves may be referred to by number respectively from 1 to 5 to correspond with those in FIGS. 15 and 17, representing grading factors P (+ 1 inch/-3/8th inch) respectively of 0.06, 0.37, 4.6, 12.5 and 60. The grading factors increase in FIG. 11 from "aggregate" grading to the left, to a single-size grading to the right.

In FIG. 11 the vertical scale indicates the percentage of sample material which will fall through a sieve of the size indicated by the horizontal scale.

Figure 12:
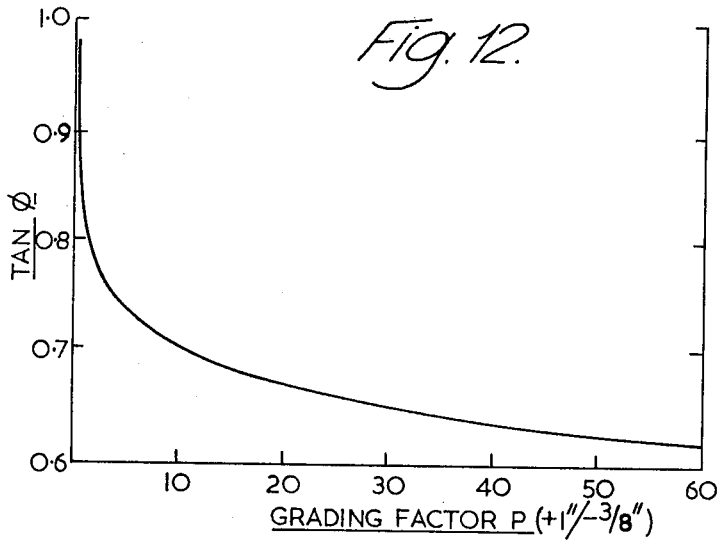
FIG. 12 is a graph between linear co-ordinates showing tan $\phi$ against grading factor P (+; inch/− 3/8th inch)

FIG. 12 shows the observed relationship between tan $\phi$ and the grading factor P obtained from data in the manner already described and by grading analysis of the material discharged from annular kilns. The curve can also be used to relate bulk density to grading factor by comparison with FIG. 9 or FIG. 10; the corresponding bulk densities in lbs/cu.ft on the vertical scale for a specific gravity of 2.7 are given approximately by $\gamma_B = 100 \tan \phi$. For another material, for example coke, the bulk density would be given approximately by $\gamma_B = 50 \tan \phi$. It is found that the relationship between $\phi$ and P(+1/− 3/8th inch) follows the equation $\tan \phi = 0.830/(P)^{1/14}$.

Figure 13:
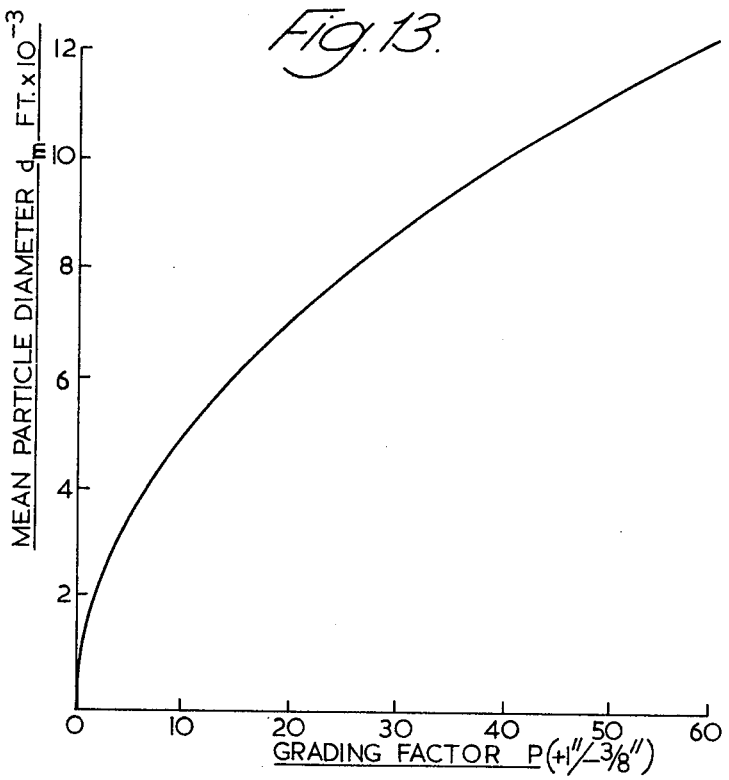
FIG. 13 is a graph between linear co-ordinates showing mean particle diameter $d_m$ against grading factor P (+1 inch/− 3/8th inch)

FIG. 13 shows the relationship between grading factor P (+1/−3/8th inch) and mean particle diameter $d_m$ (feet × $10^{-3}$), more aptly termed means granule or lump diameter based on the materials graded as shown in FIG. 11. The figures given on the vertical scale in FIG. 13 should be multiplied by a factor 5. The values of $d_m$ were obtained from thorough grading analyses of the sample materials by calculating the ratio $$\left(\Sigma \frac{m}{d} \quad \Sigma \frac{m}{d^3}\right)^2 = d_m$$

where $m$ is the proportion of particles present of diameter $d$, at a sufficient number of sampling points along each grading curve (FIG. 11).

Figure 14:
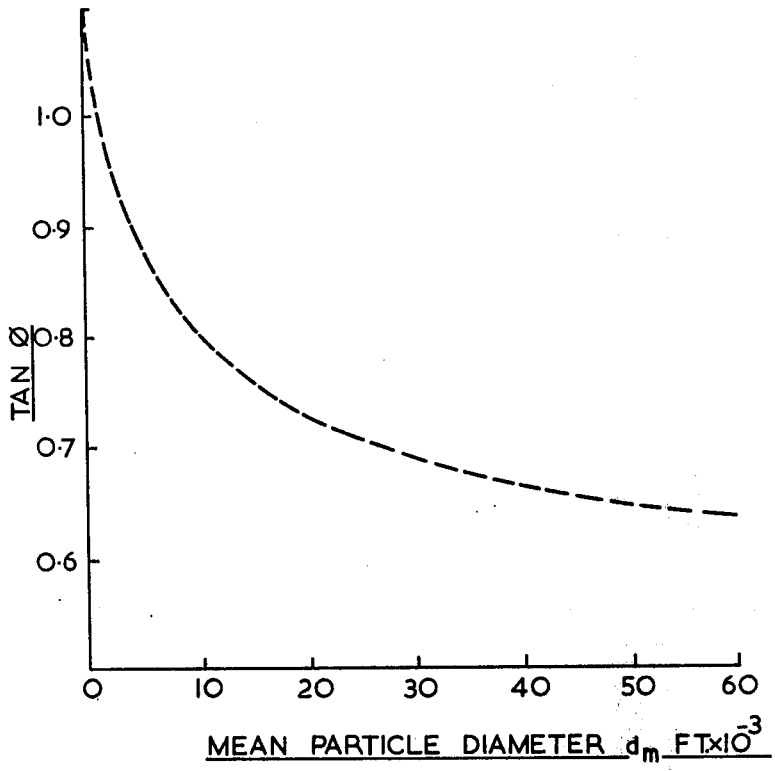
FIG. 14 is a graph between linear co-ordinates showing tan $\phi$ against mean particle diameter $d_m$.

FIG. 14 shows the relationship between tan $\phi$ and $d_m$ corresponding to FIGS. 12 and 13.

FIG. 15 shows the grading curves of FIG. 11 represented between logarithmic probability co-ordinates, numbered 1 to 5 according to grading factor P.

Figure 16:
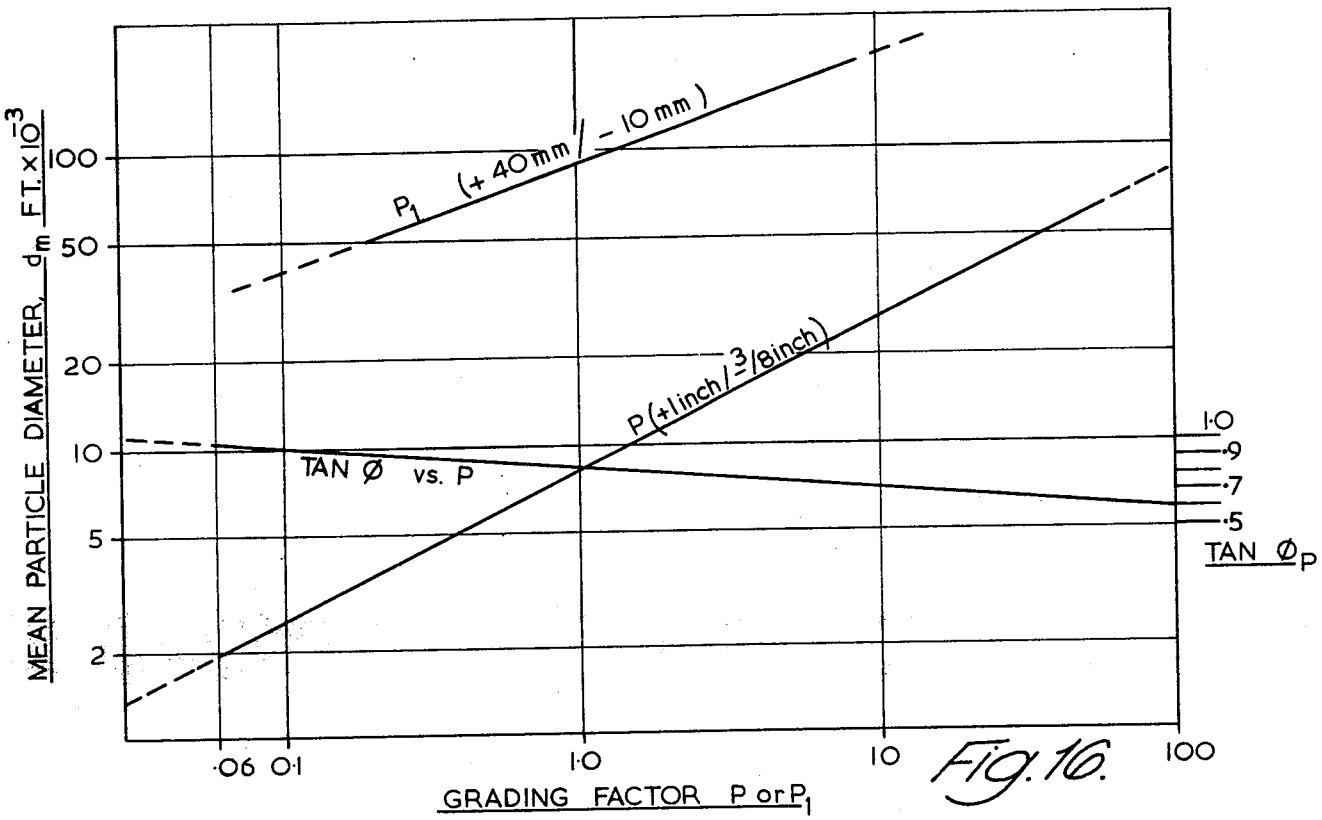
FIG. 16 is a graph between logarithmic co-ordinates showing tan $\phi$ and mean particle diameter against grading factor, in the critical mode.

FIG. 16 shows the relationship between $d_m$ and P of FIG. 13, between logarithmic co-ordinates, as well as the corresponding relationship with tan $\phi$ of FIG. 12. FIG. 16 also shows a similar relationship between $d_m$ and a grading factor $P_1$, (+40/−10 mm) relating to coke.

FIG. 17 shows the correlation between R/H, the gas flow restriction per unit height of bed (inches water gauge per inch), and G, the mass gas flow rate (pounds per minute per square foot of annular horizontal cross-sectional area). Each line represents the relationship for one of the values of grading factor P from the grading curves of FIG. 11, in the correlation $$R/HG^2 = 6.17 \times 10^{-3}/P^{1/5.93}$$

Actual and calculated values of the slope $R/HG^2 \times 10^{-3}$ are shown in foregoing Table 1, obtained with annulus areas from 5 to 350 square feet.

It is found that the relationship between $d_m$ and P follows the relation.

$d_m$ (metres)$=2.44 \sqrt{p} \times 10^{-3}$ $d_m$ (feet)$=8.0 \sqrt{P}$ $\tan \phi = 1.12\, d_m^{-0.143} \times 10^{-3}$; ($d_m$ in feet).

Figure 18:
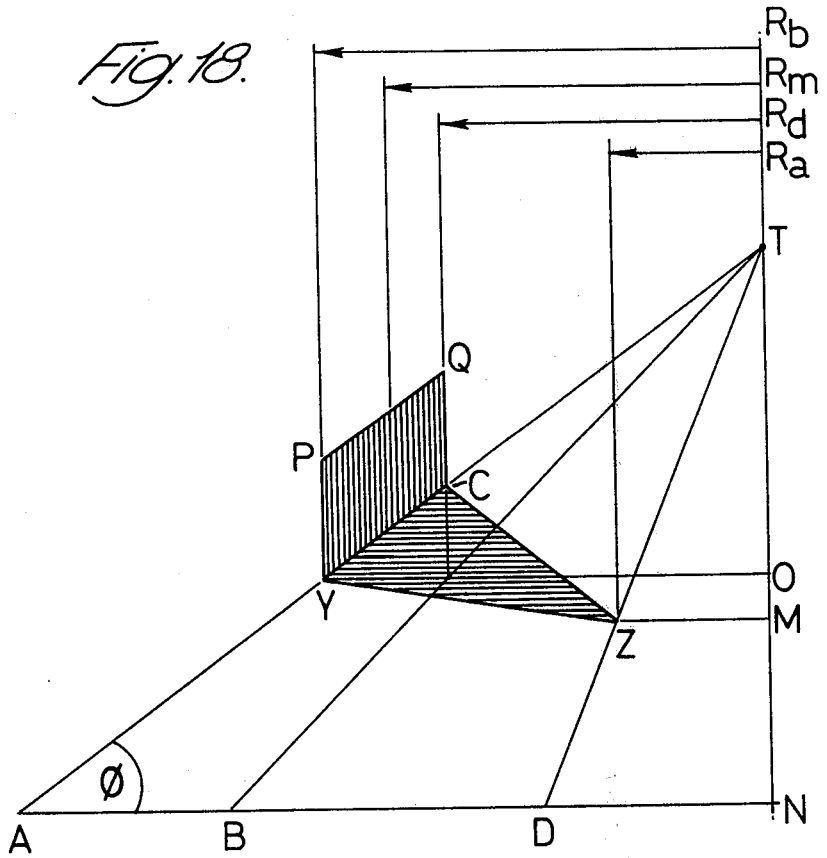
FIG. 18 is a geometrical diagram useful in determining scaled dimensions of an annular bed apparatus for operation in the critical mode.

FIG. 18 is a diagram showing the proportions of an annular bed apparatus of the general type illustrated in FIG. 1, suitable for use in the method of the present invention for charge material exhibiting an effective angle of repose $\phi$ = angle TAN in the framework TABDN.

In FIG. 18, $R_a$ = radius of discharge aperture $R_b$ = outer radius of annular bed $R_d$ = inner radius of annular bed $R_m$ = mean radius $(R_b + R_d)/2$.

Accordingly if OY represents outer bed radius of from 0.5 to over 6 metres $R_b$, the parts of the apparatus will be further represented thus:

YC = choke interface, where C is the intersection of AT with the vertical line from the intersection of TB with OY;

MZ = aperture radius, where Z is the intersection of TD with the line YZ sloping down from Y at the given floor slope angle OYZ = $\theta$, i.e. MZ = $R_a$;

CQ = vertical line through C representing the inner bed wall of radius $R_d$, and CQ = designated bed height = PY;

CZ = crater slope of the pile of charge material on the floor.

The area PQCY represents the bed, whereas CYZ represents the pile on the floor.

Operational Design

The various geometrical and operational relationships reported in the foregoing description enable the designer or operator to build or adjust annular bed apparatus to operate in the critical mode.

For instance, if one specifies a desired throughput rate Q, then the gas flow rate G required will be an ascertainable function of Q, usually of the form: $G = k_1Q$, where $k_1$ is a constant, found from thermodynamic and chemical considerations. If G is in lb/min and Q in tons/hour, $k_1$ will be about 70 for cement clinkering, 75 for coking, and 60 to 90 for various treatments of ore.

The gas restriction correlations (5A) annd (5B) for R/H, give the maximum gas flow consistent with maximum pressure drop in the critical mode, depending on available fan suction capacity, so that G/A where A is the annular area, is found in terms of P directly or via $d_m$; P is determined by the charge material, directly or via $\gamma_B$ or $\phi$. One therefore knows the maximum value for G/A and hence the minimum value for A.

Data from a wide range of apparatus gives a relationship of the form $$Q = D_b{}^n/k_2,$$

in which $D_b$ is outer wall diameter, $k_2$ is a constant and $n$ can be found. By substitution one finds $D_b = k_3A^n$ where $k_3$ is a constant.

Since A has been found, (minimum) $D_b$ is known; since $A = \pi(D_b\, a\text{-}a^2)$ by geometry, one finds a (annular width).

$\phi$, $\gamma_B$ and P are determined by or from the charge material, so that $h$ (choke height) is known from the primary relationship $h = a \tan \phi$.

The stability criterion (2) now gives $R_a$, the aperture diameter, and $\phi$, the floor slope angle, if required.

Alternative means of relating $D_b$ to A are given by the relation $A = \pi(D_b - h \cot \phi)h \cot \phi$, since $a = h \cot \phi$. If one adopts a bed height $H = 2h$, subject to correlation (5A) or (5B), the retained volume of charge in the apparatus will be $2\ \pi.\ h^2 \cot \phi\ (D_b - h \cot \phi)$ from which considerations of heat exchange can be worked out, bearing in mind that $\phi$ determines R/H and $\delta_B$.

The retained volume also $= Qt/\delta_{BT} \times 60$, where $t$ is the residence time, and $\delta_{BT}$ is the bulk density in tons per cubic foot.

The volume of charge material on the floor under the choke interface is $\pi(D_b - 2a)\ h^2\ .\ \cot \phi \times$ S.F. where S.F. is a factor depending on the stability criterion.

With dimensions $D_b$ and $R_a$ known, the details of FIG. 18 are fixed and the annular bed can be built and set up for operation. The bed height H, subject to limitations set by the foregoing, is chosen to provide the required residence time.

From FIG. 18 the feed rate can also be checked via $R_m$ to give the offset $e$.

In operation, the choke height is adjusted to ($h$); the offset ($e$) is adjusted to give a coarse control of throughput, determining the "layer thickness" of the charge material fed through, which can be as small as $d_m$; and N, the revolution rate of the floor is adjusted to give a fine control of the throughput in dependence on detected bed top level.

If the values of $h$, $e$ and N are made continuously adjustable, the apparatus can be rendered fully automatic, thereby facilitating the maintenance of the critical mode in a compressive manner, because the necessary and sufficient number of variables to be controlled in the operation of an established bed are reduced to these three.

Advantages

Many advantages to be gained by using annular bed apparatus of the type described, in the manner according to the invention, will already be apparent from the foregoing description.

In the light of the introduction to this description it will be seen that although previous inventions have been based on the fundamental change from the circular shaft to an annular cross-section, the fact that none of these approaches has met with much practical success can be directly traced to the one missing factor, namely that in no case has there been a positive attempt, even in our Davis preheater, to achieve really effective interplay between the geometry and physical dimensions of the annular bed, the discharge mechanism and the properties and flow characteristics of the material being treated. Without such a close interrelation, it was virtually impossible to avoid those features, which were fundamentally redundant to the basic purpose of the apparatus, but which were responsible for hold-ups and lack of uniform feeding, for instance through drying, preheating and calcining stages in such apparatus.

Furthermore, because the downward feed action of the solids determines the up-draught gas flow pattern, the lack of a uniformly distributed and smooth downward feed action of the solids ensured an uneven degree of heat or other treatment at any given layer; these same redundant features were therefore responsible hitherto for an irregular soild-gas contact and for a drastic limitation in the total efficiency of the heat treatment or other process.

The advantages of operating an annular bed apparatus in the manner of the present invention may be summarized as follows.

The type of apparatus employed itself has the merits of simplicity of design, robustness, and compactness, and because it is a rotary device without a grate, of being easy in principle to supply uniformly with solids to be treated. These merits may be exploited more fully by means of the invention, with minimal capital outlay, for instance in relation to plant and associated engineering facilities. In operation, positive control systems can be easily applied and little attention is needed.

Economy is a major advantage of operation according to the invention. Where heat treatment is involved, heat losses are minimised; in the critical mode there is negligible heat loss through the walls even in the absence of massive insulation. Over the floor or hearth a hot zone is continuously re-established across the full area of the charge, with no grate bars to hinder it, so that maximum efficency can be attained. The work capacity of the apparatus is high in relation to its size and it can be scaled-up in size by simple geometry, taking full advantage of any desired increase in height in relation to diameter. Since the primary cause of the feed action is the force of gravity, the applied motive power required to turn the bed is very low, for instance of the order of 15 H.P for a bed of 6 metres in diameter and 1 metre in height of cement-making raw materials, to turn a load of over 300 tons. The facility for true soild-gas contraflow contact permits efficient drying or other heat transfer.

Annular bed apparatus in the critical mode is capable of precise and easy individual control of all parameters, to maintain the required balance between geometrical features, the discharge mechanism, and flow properties of the treated solid. The feed control is volumetric, applied at the discharge end where, in a heat process, the material fed is dry. The operation lends itself readily to complete, accurate and fully automatic control.

The apparatus operated according to the invention is flexible in its application and in its operation. It can be applied to a great variety of processes, some hitheto impractical or even impossible. It may be readily associated in a production sequence with other plant, such as pelletiser, or a kiln or other furance or it may perform a self-contained process on its own. The solid charge can be subjected to a wide range of residence times tailored to suit requirements and the plant can be conveniently stopped and started without damage to the charge or loss of material. The bed can cope with sub-standard feed material and even with a dust-laden gas supply.

By virtue By optimum uniformity in respect of residence time, feeding rate, distribution and treatment of solid and gas, a high standard of quality and consistency can be maintained in the product, which suffers minimal degradation in the process. The technique of the invention takes advantage of nodule quality instead of debasing it.

In the apparatus operating in the critical mode there is a notable absence of high stress and of high temperature moving parts. The low system resistance permits it to be used with friable or even dusty loads, without losing the smooth, gentle feed action.

Although the invention has been described and illustrated primarily in terms of heat treatment of materials, for instance raw materials used in the manufacture of cement, it can also be applied to heat treatment of ores and other materials. The invention can also be applied to great advantage in other processes which involve the cooling, as opposed to the heating, of materials.

The invention may also be applied to chemical processes, and in the cleaning or other treatment of gases with solid material in granular, nodular or pebble form, or indeed in any circumstances in which contact is desired to be effected between solids and gases. Particular examples are the heat hardening of pellets formed from iron ore concentrates and also the heat hardening and partial reduction of pellets containing a mixture of iron ore concentrates and finely ground coke or coal, the latter giving a carbon bearing nodule for final reduction in a smelting furance. Other applications include lime burning, including the calcination of lime-bearing pellets; the production of light-weight aggregates, e.g., the heat hardening and bloating of nodules formed from clay or shale or other suitable mineral or waste products; and the drying and carbonising of coal, including pelletised material.

I claim:

1. The method of treating loose solid material in a generally upright annular bed formed between substantially coaxial inner and outer cylindrical walls spaced from each other by a radial bed width $a$, said bed being further supported on an annular floor having a central aperture and a substantially flat, peripheral region with a region sloping from the peripheral region downward toward the central aperture, the outer wall being in gas-tight sliding relationship with the flat peripheral region of the floor and the inner wall being positioned with its bottom edge at a height $h$ above the bottom edge of the outer wall and rotationally free with respect to the outer wall, comprising the steps of a. establishing and maintaining a bed of loose solid material by supplying loose solids to said annular chamber, b. rotating said floor on an axis radially offset from the axis of the annular chamber, c. passing a gas in counterflow with the material in said annular bed, d. discharging treated solids from said annular bed through the central aperture in said floor, and e. establishing and maintaining a stable critical mode by modulating at least one of said height $h$ and the angle of repose $\phi$ of the treated material at the bottom of the bed to maintain the relationship in which tan $\phi$ is in the range between $h/a$ and $1.1 \times h/a$.

2. The method of claim 1 in which the one of the height $h$ and the angle of repose $\phi$ is modulated continuously and automatically.

3. The method of claim 1 in which the height $h$ is maintained substantially constant and the size grading of the loose solid material is modulated.

4. The method of claim 1 in which the height $h$ is modulated in response to a sensed parameter of the treated material which varies in a predetermined manner with the angle of repose $\phi$ thereof.

5. The method of claim 4 in which the sensed parameter is the bulk density of the treated material.

6. The method of claim 4 in which the sensed parameter is the ratio between a first fraction of the treated material which exceeds a first predetermined size and a second fraction of the treated material which is smaller than a second predetermined size which would fit in the interstitial voids of the first fraction.

7. The method of claim 1 including modulating the height $h$ to maintain the relationship in which tan $\phi$ is substantially equal to $h/a$ in response to a sensed operational condition of the process.

8. The method of claim 7 in which the height $h$ is modulated automatically in response to the sensed operational condition.

9. The method of claim 7 in which the sensed operational condition is the line of maximum lateral thrust on the annular chamber and the line of thrust is maintained perpedicular to the radial line between the offset centers of rotation of the floor and of the inner and outer walls.

10. The method of claim 7 in which the sensed operational condition is a rotational lag of the outer wall behind that of the floor, and the lag is maintained at a circumferential distance equal to the stroke length of twice the radial offset distance between the axis of the floor and the axis of the inner and outer walls.

11. The method of claim 7 in which the sensed operational condition is the power consumption, and the power consumption is maintained at a minimum.

12. The method of claim 7 in which the sensed operational condition is the point of maximum discharge of treated material through the center aperture of the floor, and the point of maximum discharge is maintained along a line substantially perpendicular to the radial line of offset of the floor and of the inner and outer walls.

13. The method of claim 7 in which the sensed operational condition is the pressure drop across the annular bed, and the pressure drop is maintained at a minimum attainable value for a given bed height in normal operation.

14. The method of claim 7 in which the sensed operational condition is the change by treatment in the discharged material and the change by treatment is maintained uniform.

15. The method of claim 7 in which the sensed operational condition is the lateral thrust of the annular bed and the lateral thrust is maintained at a minimum.

16. The method of claim 7 in which the sensed operational condition is the rate of discharge of treated material and the rate of discharge is maintained linearly proprotional to the radial offset distance between the axis of the floor and that of the inner and outer walls.

17. The method of claim 16 in which the offset distance is established substantially equal to the mean particle diameter of the treated solids and the rotational speed of the floor is modulated to maintain a substantially uniform depth of material in the annular bed.

* * * * *